US006796627B2

(12) United States Patent
Kimura et al.

(10) Patent No.: US 6,796,627 B2
(45) Date of Patent: Sep. 28, 2004

(54) INK JET RECORDING APPARATUS, METHOD OF REPLENISHING INK TO SUBTANK IN THE APPARATUS, AND METHOD OF CHECKING THE REPLENISHED AMOUNT OF INK

(75) Inventors: Hitotoshi Kimura, Nagano (JP); Atsushi Kobayashi, Nagano (JP); Noboru Tamura, Nagano (JP); Hiroaki Tojyo, Nagano (JP); Yoshiharu Aruga, Nagano (JP); Minoru Usui, Nagano (JP); Kazunaga Suzuki, Nagano (JP); Takashi Mano, Nagano (JP); Toshio Kumagai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/898,080

(22) Filed: Jul. 5, 2001

(65) Prior Publication Data

US 2002/0024543 A1 Feb. 28, 2002

Related U.S. Application Data

(63) Continuation-in-part of application No. PCT/JP00/07783, filed on Nov. 6, 2000.

(30) Foreign Application Priority Data

| | | |
|---|---|---|
| Nov. 5, 1999 | (JP) | P.11-315071 |
| Dec. 6, 1999 | (JP) | P.11-346354 |
| Jan. 20, 2000 | (JP) | P.2000-011109 |
| Jan. 21, 2000 | (JP) | P.2000-012461 |
| Jan. 21, 2000 | (JP) | P.2000-012462 |
| Feb. 1, 2000 | (JP) | P.2000-024420 |
| Feb. 1, 2000 | (JP) | P.2000-024422 |
| Feb. 18, 2000 | (JP) | P.2000-041722 |
| Jul. 11, 2000 | (JP) | P.2000-209885 |
| Nov. 2, 2000 | (JP) | P.2000-335736 |

(51) Int. Cl.[7] ..... B41J 2/175
(52) U.S. Cl. ..... 347/7; 347/85
(58) Field of Search ..... 347/6, 7, 14, 19, 347/23, 30, 35, 85, 86, 87, 89, 90; 251/331

(56) References Cited

U.S. PATENT DOCUMENTS

| | | | | |
|---|---|---|---|---|
| 3,628,770 A | * | 12/1971 | Rost | 251/331 |
| 3,761,953 A | * | 9/1973 | Helgeson et al. | 347/7 |

(List continued on next page.)

FOREIGN PATENT DOCUMENTS

| | | | | |
|---|---|---|---|---|
| EP | 841173 A2 | * | 5/1998 | B41J/2/175 |
| JP | 56-147017 | | 11/1981 | |
| JP | 58096561 A | * | 6/1983 | |
| JP | 5-96741 | | 4/1993 | |
| JP | 8-207315 | | 8/1996 | |

(List continued on next page.)

OTHER PUBLICATIONS

Patent abstract of Japan 10–138506, May 26, 1998.
Patent abstract of Japan 11–300986, Nov. 2, 1999.

(List continued on next page.)

*Primary Examiner*—Juanita Stephens
*Assistant Examiner*—Blaise Mouttet
(74) *Attorney, Agent, or Firm*—Sughrue Mion, PLLC

(57) ABSTRACT

In an ink jet recording apparatus, a recording head is mounted on a carriage which reciprocately moves in a widthwise direction of recording paper. A subtank is mounted on the carriage for supplying ink. A main tank stores ink which is replenished to the subtank. An ink amount detector detects an amount of ink stored in the subtank. A replenishment controller controls replenishment of ink stored in the main tank to the subtank, in accordance with the ink amount detected by the ink amount detector.

60 Claims, 27 Drawing Sheets

U.S. PATENT DOCUMENTS

| | | | | | |
|---|---|---|---|---|---|
| 3,967,549 | A | * | 7/1976 | Thompson et al. | 347/125 |
| 3,991,788 | A | * | 11/1976 | Kull | 137/608 |
| 4,178,595 | A | * | 12/1979 | Jinnai et al. | 347/7 |
| 4,432,005 | A | * | 2/1984 | Duffield et al. | 347/86 |
| 4,433,341 | A | * | 2/1984 | Thomas | 347/6 |
| 4,466,284 | A | * | 8/1984 | Dumery | 73/313 |
| 4,555,712 | A | * | 11/1985 | Arway et al. | 347/7 |
| 4,636,814 | A | * | 1/1987 | Terasawa | 347/7 |
| 4,677,448 | A | * | 6/1987 | Mizusawa et al. | 347/85 |
| 4,680,696 | A | * | 7/1987 | Ebinuma et al. | 347/85 |
| 4,737,801 | A | * | 4/1988 | Ichihashi et al. | 347/85 |
| 5,136,305 | A | * | 8/1992 | Ims | 347/7 |
| 5,136,309 | A | * | 8/1992 | Iida et al. | 347/7 |
| 5,606,353 | A | * | 2/1997 | Mochizuki et al. | 347/23 |
| 5,616,929 | A | * | 4/1997 | Hara | 250/573 |
| 5,673,072 | A | * | 9/1997 | Scheffelin | 347/85 |
| 5,751,300 | A | * | 5/1998 | Cowger et al. | 347/6 |
| 5,757,390 | A | * | 5/1998 | Gragg et al. | 347/7 |
| 5,801,735 | A | * | 9/1998 | Lorenze, Jr. et al. | 347/85 |
| 6,000,778 | A | * | 12/1999 | Koitabashi et al. | 347/23 |
| 6,155,664 | A | * | 12/2000 | Cook | 347/7 |
| 6,158,850 | A | * | 12/2000 | Cook | 347/85 |
| 6,267,474 | B1 | | 7/2001 | Mochizuki | |
| 6,290,343 | B1 | * | 9/2001 | Lewis et al. | 347/85 |

FOREIGN PATENT DOCUMENTS

| | | | | |
|---|---|---|---|---|
| JP | 3046244 | | 12/1997 | |
| JP | 10-114085 | | 5/1998 | |
| JP | 10-138506 | | 5/1998 | B41J/2/175 |
| JP | 10-305594 | | 11/1998 | |
| JP | 11-48492 | | 2/1999 | |
| JP | 11-48493 | | 2/1999 | |
| JP | 11-115218 | | 4/1999 | |
| JP | 11-188895 | A | 7/1999 | |
| JP | 11-192720 | A | 7/1999 | |
| JP | 11-192732 | | 7/1999 | B41J/2/175 |
| JP | 11-216874 | | 8/1999 | |
| JP | 11-300986 | | 11/1999 | B41J/2/175 |
| WO | 99/41083 | | 8/1999 | B41J/2/175 |

OTHER PUBLICATIONS

Patent abstract of Japan 11–192732, Jul. 21, 1999.

Abstract EP1055520, Nov. 29, 2000 (WO99/41083 Aug. 19, 1999).

International Search Report.

Japanese Office Action.

* cited by examiner

INK JET RECORDING APPARATUS, METHOD OF REPLENISHING INK TO SUBTANK IN THE APPARATUS, AND METHOD OF CHECKING THE REPLENISHED AMOUNT OF INK

CROSS-REFERENCE TO RELATED APPLICATION

This is a continuation-in-part application of PCT/JP00/07783 filed on Nov. 6, 2000, which was published under PCT Article 21(2) in Japanese and the complete disclosure of which is incorporated into this application by reference.

BACKGROUND OF THE INVENTION

This invention relates to an ink jet recording apparatus wherein a subtank for supplying ink to a recording head is mounted on a carriage on which the recording head is mounted, and the subtank is replenished with ink in succession from a main tank via an ink replenishing tube, a method of replenishing ink to the subtank, and a method of checking the replenished amount of ink to the subtank.

An ink jet recording apparatus can form small dots at a high density with relatively small noise at the print time, and thus nowadays is used for various types of print including color print. Such an ink jet recording apparatus generally comprises an ink jet recording head mounted on a carriage and moving in a width direction of recording paper, and a paper feeder for relatively moving the recording paper in a direction orthogonal to a move direction of the recording head so that ink drops are ejected from the recording head based on print data, to perform recording on the recording paper.

The recording head capable of ejecting black ink, yellow ink, cyan ink, and magenta ink, for example, is mounted on the carriage and not only text print in black ink, but also full color print is enabled by varying a ratio of the respective inks ejected.

On the other hand, in this kind of recording apparatus provided for offices or business, for example, it becomes necessary to dispose a large-capacity ink cartridge to deal with a relatively large amount of print, and thus a recording apparatus of the type wherein a main tank as an ink cartridge is placed in a placement unit (cartridge holder) placed on a side of the recording apparatus main unit, for example, is provided.

Subtanks are placed on the carriage on which the recording head is mounted and each subtank is replenished with ink from the main tank via an ink replenishing tube, and further ink is supplied from each subtank to the recording head.

By the way, nowadays a large-sized recording apparatus with a long scanning distance of a carriage capable of printing on a large paper face is demanded. In such a recording apparatus, to improve throughput, a recording head is provided with a larger number of nozzles more and more. Further, to improve throughput, a recording apparatus wherein while print is executed, each subtank mounted on a carriage can be replenished with ink in succession from a main tank and ink is supplied stably from each subtank to the main tank is demanded.

In such a recording apparatus, an ink replenishing tube needs to be connected from the main tank to each subtank corresponding to each ink and the scan distance of the carriage is large and thus the tube run length grows inevitably. Moreover, a recording head is provided with a larger number of nozzles as mentioned above and thus a technical problem is involved wherein the consumed ink amount is large, the dynamic pressure of ink is thus raised in each ink replenishing tube connected from the main tank to each subtank, and the replenished amount of each subtank with ink is thereby insufficient.

As one means for solving such a problem, for example, a configuration for applying an air pressure to the main ink side and generating a forcible ink flow by the air pressure from the main tank to each subtank for replenishing the subtank with necessary and sufficient ink can be adopted.

To attempt to adopt such a configuration, it is necessary to manage so that the ink amount in each subtank always becomes a predetermined range, and the necessity of adopting a function capable of adjusting the acceptance amount of ink from the main tank in each subtank occurs.

SUMMARY OF THE INVENTION

It is therefore an object of the invention to provide an ink jet recording apparatus capable of properly managing the amount of ink with which a subtank is replenished from a main tank, a method of replenishing ink to a subtank in the recording apparatus, and a method of checking the replenished amount of ink to the subtank.

In order to achieve the above object, according to the invention, there is provided an ink jet recording apparatus comprising:

- a recording head, mounted on a carriage which reciprocately moves in a widthwise direction of recording paper;
- a subtank, mounted on the carriage for supplying ink;
- a main tank, storing ink which is replenished to the subtank;
- an ink amount detector, which detects an amount of ink stored in the subtank; and
- a replenishment controller, which controls replenishment of ink stored in the main tank to the subtank, in accordance with the ink amount detected by the ink amount detector.

According to the invention, there is also provided a method of replenishing ink stored in a main tank to a subtank mounted on a carriage reciprocately moving in a widthwise direction of recording paper, together with a recording head, which are incorporated in an ink jet recording apparatus, the method comprising the steps of:

- applying pressure generated by a compressor to the main tank;
- operating an ink replenishing valve provided in a replenishment passage which connects the main tank and the subtank, so as to be opened and closed repeatedly in accordance with an amount of ink stored in the subtank.

According to the invention, there is also provided a method of checking replenishment of ink stored in a main tank to a subtank mounted on a carriage reciprocately moving in a widthwise direction of recording paper, together with a recording head, which are incorporated in an ink jet recording apparatus, the method comprising the steps of:

- detecting an ink amount replenished to the subtank;
- discharging ink from the recording head when it is detected an ink overflow state in which the replenished ink amount detected by the detecting step exceeds a predetermined value;
- checking whether the subtank is in the ink overflow state by detecting again an ink amount replenished to the subtank, after the discharging step;

continuing a printable state of the apparatus when the ink overflow state is not detected by the checking step; and determining an error state of the apparatus when the ink overflow state is detected by the checking step.

Alternatively, the checking method may comprise the steps of:

detecting an ink amount replenished to the subtank;

discharging ink from the recording head when it is detected an ink overflow state in which the replenished ink amount detected by the detecting step exceeds a predetermined value, while incrementing a number of which the ink overflow state is detected;

repeating the discharging step and the incrementing step while comparing the detected number with a predetermined number; and detecting an error state of the apparatus when the detected number reaches the predetermined number.

Alternatively, the checking method may comprise the steps of:

detecting an ink amount replenished to the subtank;

performing a predetermined amount of printing when it is detected an ink overflow state in which the replenished ink amount detected by the detecting step exceeds a predetermined value;

checking whether the subtank is in the ink overflow state by detecting again an ink amount replenished to the subtank, after the printing step;

continuing a printable state of the apparatus when the ink overflow state is not detected by the checking step; and determining an error state of the apparatus when the ink overflow state is detected by the checking step.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Embodiments of ink jet recording apparatuses according to the invention will be discussed with reference to the accompanying drawings.

Figure 1:
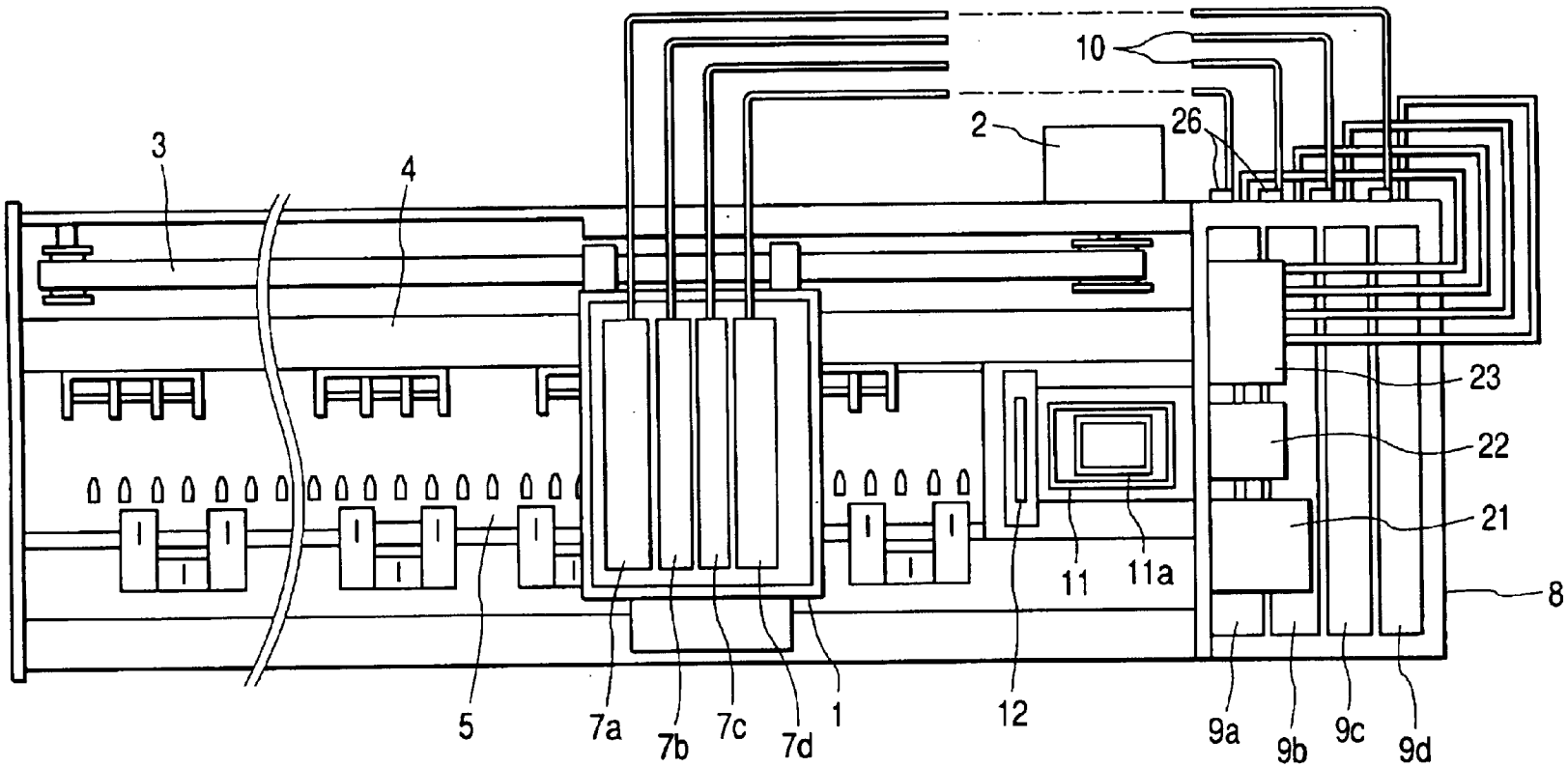
FIG. 1 is a plan view to show the general configuration of an ink jet recording apparatus incorporating the invention.

FIG. 1 shows an example of an ink jet recording apparatus incorporating the invention as a top view.

In FIG. 1, a carriage 1 is guided by a scanning guide member 4 via a timing belt 3 driven by a carriage motor 2 and is reciprocated in a main scanning direction of the longitudinal direction of a paper feeder 5, namely, the width direction of recording paper. Although not shown in FIG. 1, an ink jet recording head 6 described later is mounted on a face of the carriage 1 opposed to the paper feeder 5.

Subtanks 7*a* to 7*d* for supplying ink to the recording head 6 are also mounted on the carriage 1. In the embodiment, to temporarily store inks in the subtanks, four subtanks 7*a* to 7*d* are provided in a one-to-one-correspondence with the inks.

Black ink, yellow ink, magenta ink, and cyan ink are supplied to the subtanks 7*a* to 7*d* via flexible ink replenishing tubes 10 forming ink supply passages from main tanks 9*a* to 9*d* as ink cartridges placed in a cartridge holder 8 placed at an end part of the recording apparatus.

On the other hand, a capping unit 11 capable of sealing a nozzle formation face of the recording head is placed in a non-print area (home position) on the move passage of the carriage 1 and further a cap member 11 a formed of a flexible material of rubber, etc., capable of sealing the nozzle formation face of the recording head is placed on the top of the capping unit 11. When the carriage 1 moves to the home position, the nozzle formation face of the recording head is sealed by the cap member 11*a*.

The cap member 11*a* serves as a lid for sealing the nozzle formation face of the recording head 6 for preventing nozzle openings from drying, during the non-operating period of the recording apparatus. One end of a tube in a suction pump (tube pump) is connected to the cap member 11*a* although not shown in the figure, and the cleaning operation of causing a negative pressure produced by the suction pump to act on the recording head for sucking and discharging ink from the recording head 6 is executed.

A wiper 12 made of an elastic material of rubber, etc., is placed on the print area side of the capping unit 11 to wipe and clean the nozzle formation face of the recording head as required.

Figure 2:
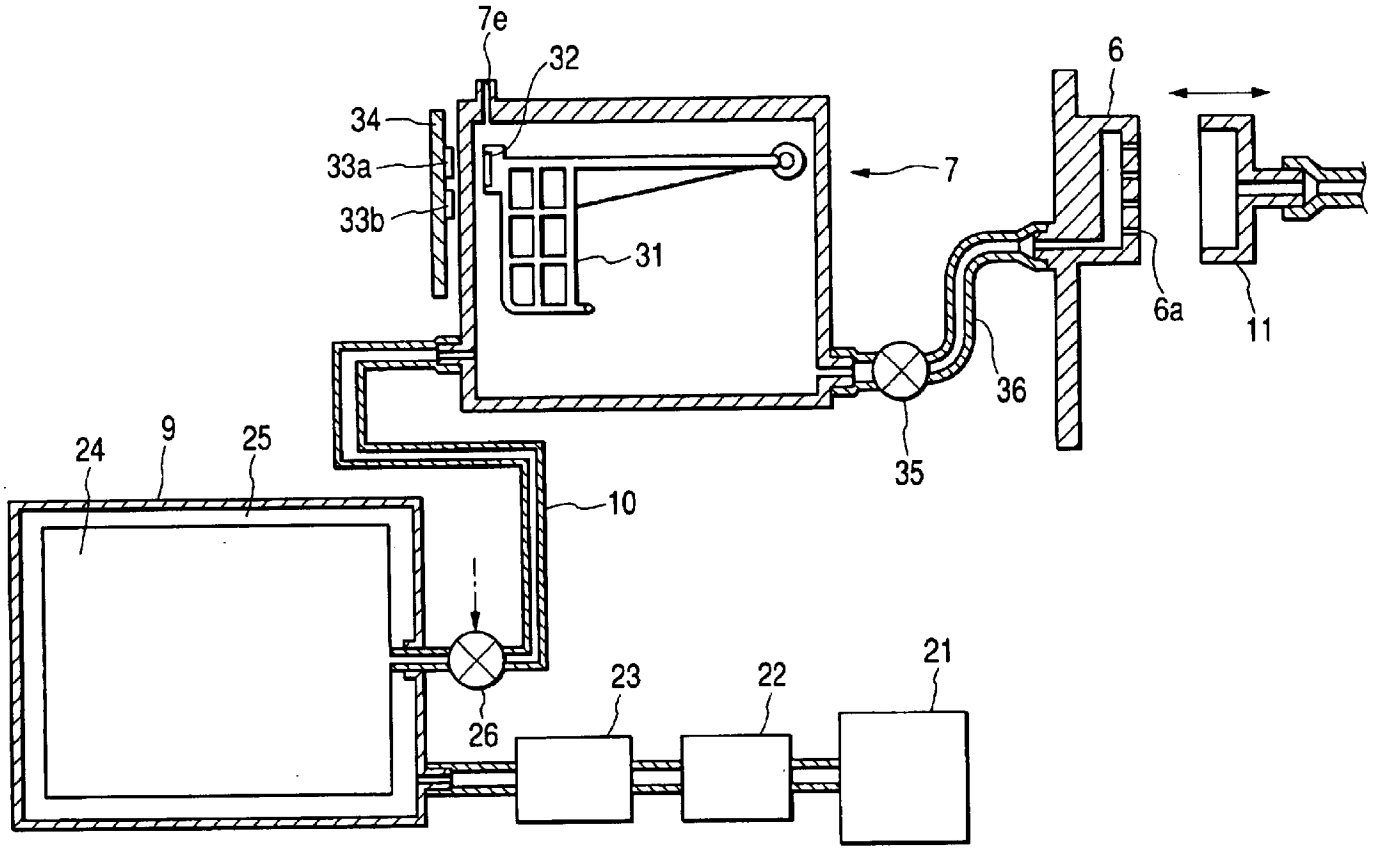
FIG. 2 is a schematic drawing to show an ink supply system from a main tank to a recording head, according to a first embodiment of the invention.

Next, FIG. 2 schematically shows the configuration of an ink supply system installed in the recording apparatus shown in FIG. 1. The ink supply system will be discussed together with FIG. 1 with the same numerals shown. In FIGS. 1 and 2, air compressed by an air compressing pump 21, which forms a part of a compressor unit, is supplied to a pressure regulating valve 22 also serving as an atmospheric release valve, and further is supplied via a pressure detector 23 to the main tanks 9*a* to 9*d* (denoted representatively by numeral 9 in FIG. 2 and in the description to follow, the main tanks may be representatively denoted simply by numeral 9).

The pressure regulating valve 22 also serving as an atmospheric release valve has a function of releasing pressure for maintaining the air pressure applied to each of the main tanks 9*a* to 9*d* in a predetermined range when the air pressure compressed by the air compressing pump 21 reaches a predetermined pressure or more. The pressure release valve also has a function capable of releasing the compressed state produced by the air compressing pump 21 in response to an instruction.

Further, the pressure detector 23 senses the air pressure compressed by the air compressing pump 21 and controls driving the air compressing pump 21. That is, if the pressure detector 23 detects the air pressure compressed by the air compressing pump 21 reaching the predetermined pressure, it stops driving the air compressing pump 21 and if the pressure detector 23 detects the air pressure compressed by the air compressing pump 21 becoming less than determined pressure, it drives the air compressing pump 21, and this control sequence is repeated, thereby maintaining the air pressure applied to each of the main tanks 9*a* to 9*d* in the predetermined range. As the schematic structure of the main tank 9 is shown in FIG. 2, the outer hull of the main tank is hermetically formed and an ink pack 24 formed of a flexible material in which ink is sealed is stored in the main tank. The space formed by the main tank 9 and the ink pack 24 forms an air chamber (pressure chamber) 25 and compressed air via the pressure detector 23 is supplied to the inside of the air chamber 25.

According to the configuration, each ink pack 24 stored in each of the main tanks 9*a* to 9*d* undergoes pressurization of the compressed air and an ink flow under a predetermined pressure is produced from each of the main tanks 9*a* to 9*d* to each of the subtanks 7*a* to 7*d*.

Ink compressed in each of the main tanks 9*a* to 9*d* is supplied to each of the subtanks 7*a* to 7*d* mounted on the carriage 1 (the subtanks are denoted representatively by numeral 7 in FIG. 2 and in the description to follow, the subtanks may be representatively denoted simply by numeral 7) via each of ink replenishing valves 26 and each of the ink replenishing tubes 10 forming an ink replenishing controller.

Although the configuration of the subtank 7 shown in FIG. 2 will be described later in detail, in the basic configuration of the subtank 7, a float member 31 is placed in the subtank and a permanent magnet 32 is attached to a part of the float member 31. Magnetoelectric devices 33*a* and 33*b* (in the description to follow, the magnetoelectric devices may be representatively denoted simply by numeral 33) represented by hall devices are placed on a board 34 and are attached to a side wall of the subtank 7.

According to the configuration, the permanent magnet 32 placed on the float member 31 and the hall devices 33*a* and 33*b* for producing electric output in response to the magnetic flux density of the permanent magnet 32 following the float position of the float member 31 make up an ink amount detector.

Therefore, for example, if the ink amount in the subtank 7 becomes low, the position of the float member 31 housed in the subtank moves in a gravity direction and the position of the permanent magnet 32 also moves in the gravity direction accordingly. Therefore, the electric output of the hall devices 33*a* and 33*b* as the permanent magnet moves can be sensed as the ink amount in the subtank 7, and the ink replenishing valve 26 is opened based on the electric output provided by the hall devices 33*a* and 33*b*.

Thus, the ink compressed in the main tank 9 is supplied separately to the associated subtank 7 in which the ink amount lowers. If the ink amount in the subtank 7 reaches a predetermined volume, the ink replenishing valve 26 is closed based on the electric output provided by the hall devices 33*a* and 33*b*. Such a sequence is repeated, whereby the subtank is replenished intermittently with ink from the main tank and an almost constant amount of ink is always stored in each subtank.

Since each subtank 7 is thus replenished with the corresponding ink compressed by the air pressure in the main tank 9 based on the electric output based on the position of the float member 31 placed in the subtank 7, the ink replenishing response can be enhanced and the ink storage amount in the subtank 7 is managed appropriately.

Ink is supplied from each subtank 7 to the recording head 6 via a valve 35 and a tube 36 connected thereto and ink drops are ejected through nozzle openings 6*a* formed in the nozzle formation face of the recording head 6 based on print data supplied to the recording head 6. In FIG. 2, a tube connected to the capping unit 11 is connected to the suction pump (tube pump) not shown. Numeral 7*e* denotes an atmospheric release port made in the subtank 7.

Figure 3A:
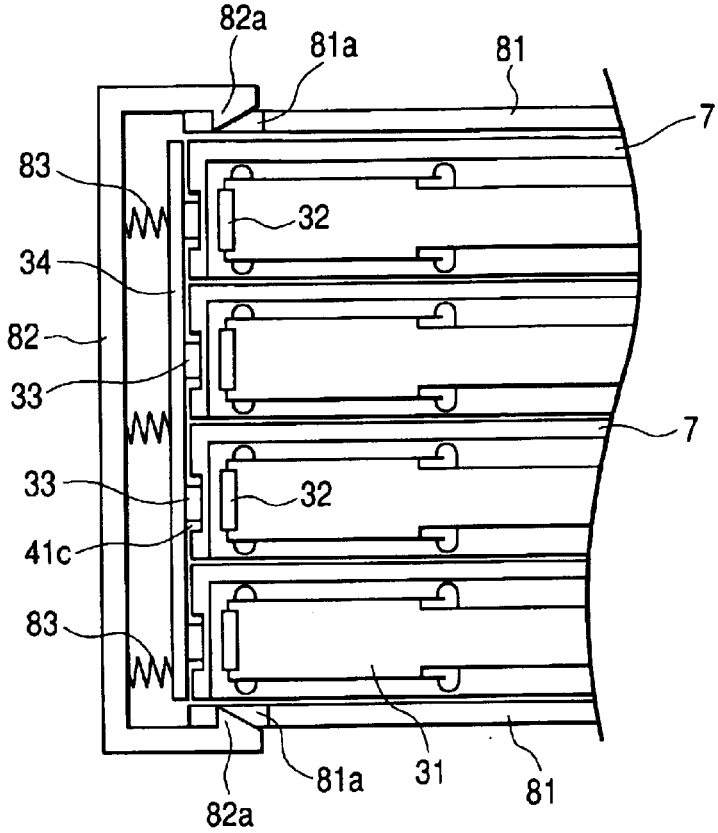
FIGS. 3A and 3B are schematic drawings to show a mode in which subtanks are arranged in parallel and magnetoelectric devices are disposed.
Figure 3B:
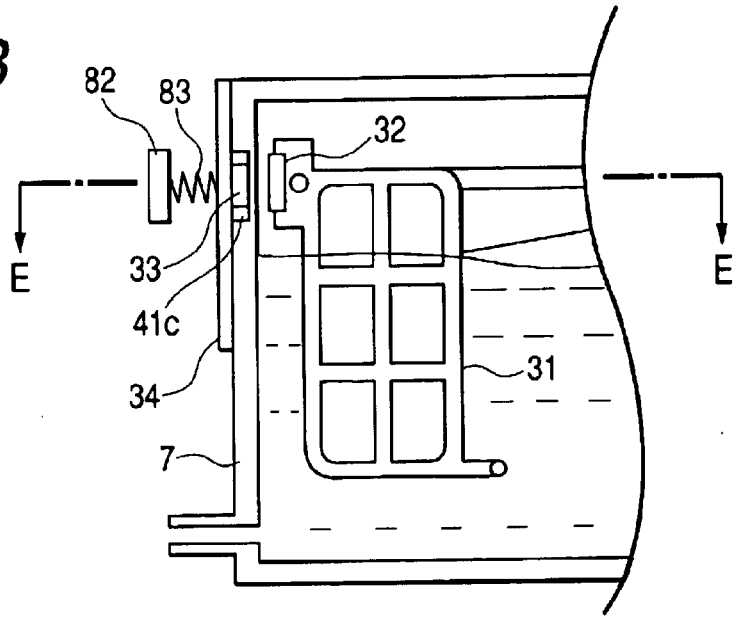

Next, disposition examples of the permanent magnet and the magnetoelectric device provided for the subtank will be discussed with reference to FIGS. 3 to 9. FIGS. 3A and 3B show a state in which the subtanks having the described configuration are arranged in parallel for making up a subtank unit and shows a mode in which the hall device 33 as the magnetoelectric device is disposed on the side wall of each subtank as a schematic drawing. FIG. 3A is a sectional view taken along a line E—E in FIG. 3B viewed in the arrow direction. FIG. 3B is a sectional view of a state in which one of the subtanks making up the subtank unit is cut in a plane direction. The subtank unit supported in a parallel state is housed in a holder 81. It comprises a board holder 82 having engagement members 82*a* for engaging with fitting holes 81*a* made in the holder 81, and the hall device 33 is placed on the side wall part of each subtank 7 in an urged state by a plurality of springs 83 placed between the board holder 82 and the board 34 on which the hall devices 33 are arranged. In the disposition example, the case where one hall device 33 is provided for each subtank is taken as an example, but two hall devices may be provided for each subtank, as described above.

In this case, as shown in the figure, the subtank 7 is formed in the side wall with a recess part 41*c* for positioning the hall device 33 and the recess part 41*c* for positioning is formed, whereby the side wall part of the subtank 7 is made thinner and the distance between the moving path of the permanent magnet 32 attached to the float member 31 and the hall device 33 can be made shorter.

Figure 4A:
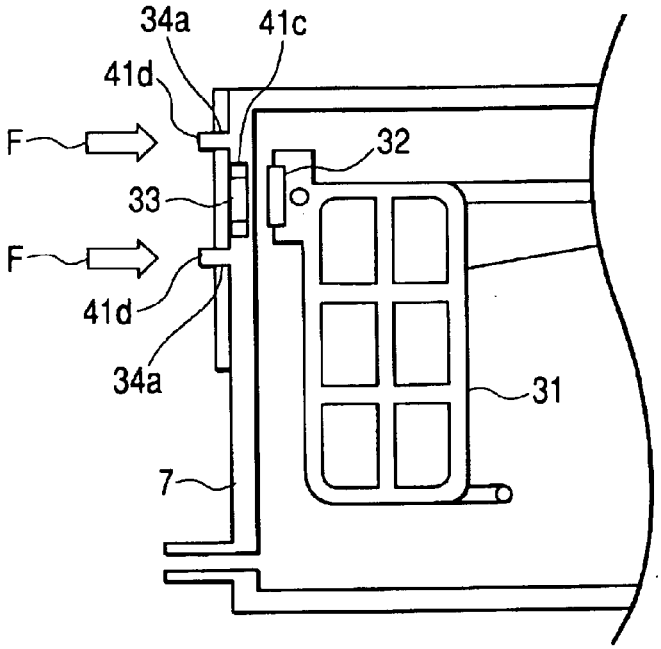
FIGS. 4A and 4B are schematic drawings to show another configuration in which a magnetoelectric device is disposed on each subtank.
Figure 4B:
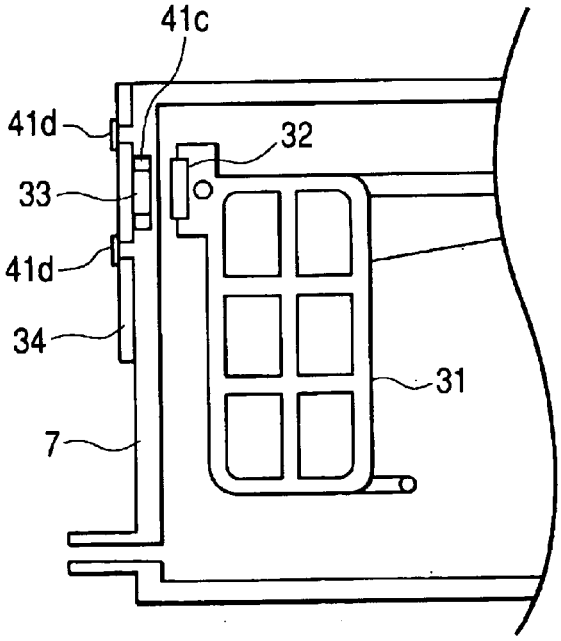

FIGS. 4A and 4B show a modified example wherein the hall device 33 as the magnetoelectric device is disposed on the side wall of the subtank 7 as a schematic drawing. In the modified example, the board 34 on which the hall devices 33 are disposed is attached to the subtanks 7 by thermal caulking. FIG. 4A shows a state just before thermal caulking is executed as a sectional view and FIG. 4B shows a state after thermal caulking is executed as a sectional view.

In this case, the subtank 7 is formed of a thermoplastic resin and is previously formed on the side wall part with a pair of projections 41*d* as shown in FIG. 4A. On the other hand, the board 34 on which the hall device 33 is mounted is formed with a pair of through holes 34*a* at the positions corresponding to the pair of projections 41*d*.

As shown in FIG. 4A, the through holes 34*a* made in the board 34 are inserted into the projections 41*d* and in this state a heated jig (not shown) is pressed against the projections 41*d* as indicated by arrows F, whereby the projections 41*d* are melted and become deformed like flat plates because of the thermoplastic property for holding the board 34 on the side wall part of the subtank 7 as shown in FIG. 4B.

Also in the example shown in the figures, the recess part 41*c* for positioning the hall device 33 is formed, whereby the side wall part of the subtank 7 is made thinner and the distance between the moving path of the permanent magnet 32 attached to the float member 31 and the hall device 33 can be made shorter.

Figure 5:
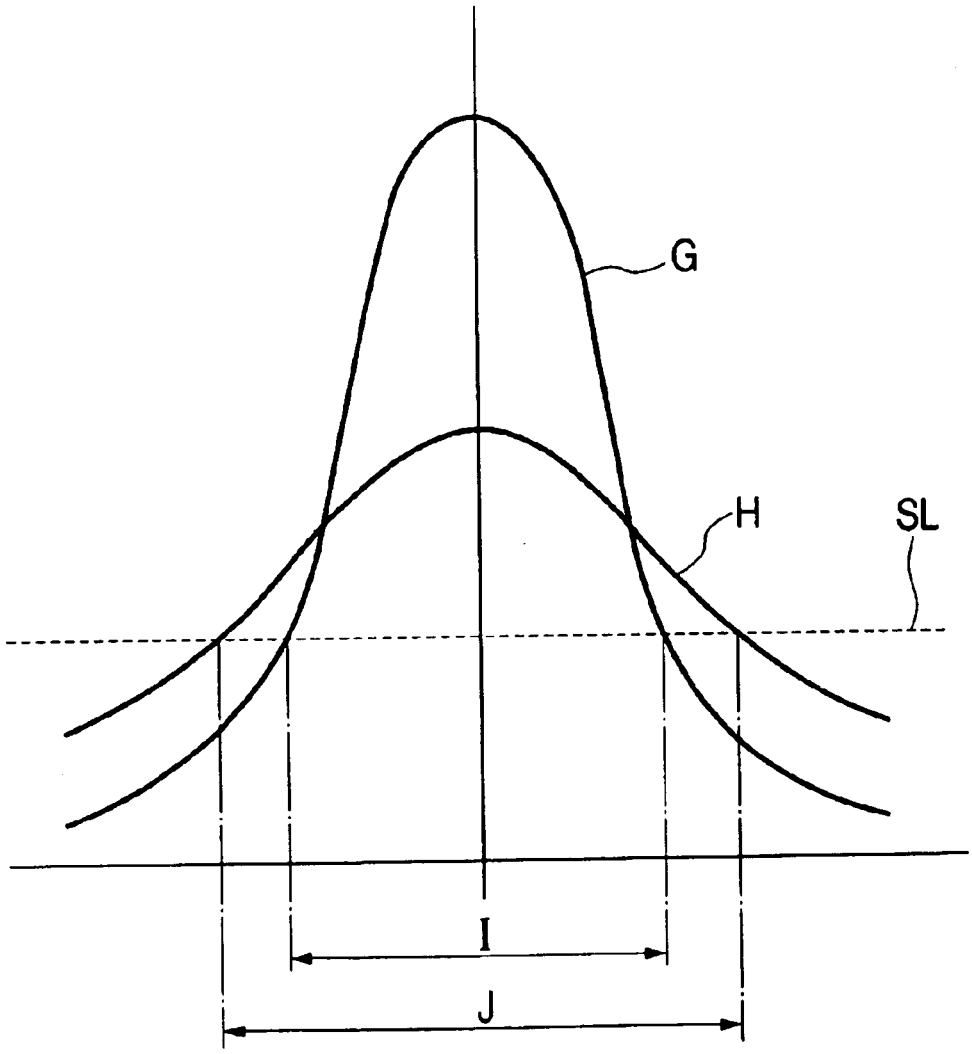
FIG. 5 is a characteristic drawing to show the relationship between a permanent magnet attached to a float member and the magnetic flux detection sensitivity of the magnetoelectric device.

The distance between the moving path of the permanent magnet and the hall device will be discussed. FIG. 5 examines the distance between the moving path of the permanent magnet 32 attached to the float member 31 and the hall device 33 as the magnetoelectric device and shows the relationship between the distance therebetween and the magnetic flux detection sensitivity of the hall device 33.

That is, a curve G indicates setting such that the distance between the moving path of the permanent magnet 32 and the hall device 33 becomes relatively short, and a curve H indicates a case where the distance between the moving path of the permanent magnet 32 and the hall device 33 is relatively long. The longitudinal solid line represents the magnetic flux density received by the hall device 33 and the lateral solid line indicates the moving path of the permanent magnet 32, namely, the displacement of the permanent magnet 32 from the center longitudinal solid line where the permanent magnet 32 is brought closest to the hall device 33.

Here, it is assumed that the electric output produced by the hall device 33 is used in a line area almost proportional to the magnetic flux density received at each (the electric output is used in the area proportional to the magnetic flux density). Therefore, if a threshold voltage (threshold level) for opening/closing the valve 26 upon reception of the electric output produced by the hall device 33 is SL in FIG. 5, the width of the area crossing SL in the characteristic G becomes narrow as indicated by I and the width of the area crossing SL in the characteristic H becomes wide as indicated by J.

In other words, as the distance between the moving path of the permanent magnet 32 and the hall device 33 is narrower, the detection sensitivity relative to of the displacement of the permanent magnet 32 can be enhanced and the detection accuracy of the remaining flow amount of ink in the subtank can be more improved. Therefore, the subtank 7 is formed in the side wall with the recess part 41*c* for positioning the hall device 33 and the side wall part of the subtank 7 is made thin in the presence of the recess part 41*c* for positioning, so that the detection accuracy of the remaining flow amount of ink in the subtank can be more improved.

Figure 6:
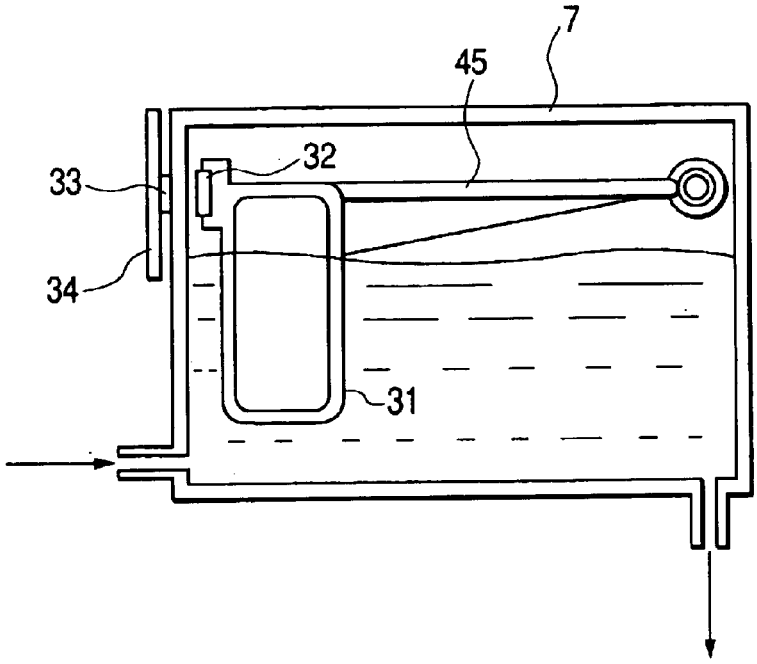
FIG. 6 is a schematic drawing to examine the relationship between the placement position of the permanent magnet attached to the float member and the placement position of the magnetoelectric device on the subtank side.
Figure 7:
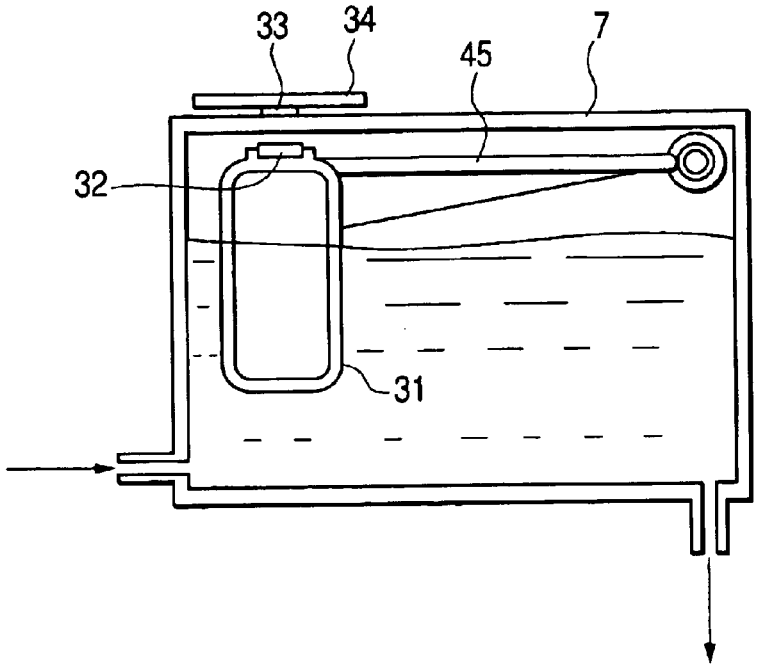
FIG. 7 is a schematic drawing to examine another configuration of the placement position of the permanent magnet attached to the float member and the placement position of the magnetoelectric device on the subtank side.

FIGS. 6 and 7 examine the relationship between the placement position of the permanent magnet attached to the float member and the placement position of the hall device as the magnetoelectric device on the subtank side. That is, in the configuration shown in FIG. 6, the hall device 33 mounted on the board 34 is placed on the side wall part of the subtank 7 and on the other hand, the permanent magnet 32 is placed on the float member 31 on an extension of a support arm 45 and the hall device 33 senses the magnetic flux density as the permanent magnet 32 placed on the float member moves in the gravity direction. That is, the configuration shown in FIG. 6 is a similar configuration to that of the embodiment shown in FIGS. 2 to 4.

On the other hand, in the configuration shown in FIG. 7, the hall device 33 mounted on the board 34 is placed on the upper wall of the subtank 7 and the permanent magnet 32 is placed on the upper wall of the float member 31. The magnetic flux density change on the hall device 33 as the permanent magnet 32 placed on the float member 31 moves in the gravity direction is sensed. Therefore, in the configuration shown in FIG. 7, electric output responsive to the remaining flow amount of ink in the subtank 7 can also be produced and the mode can also be adopted effectively.

However, in the configuration of placing a plurality of hall devices for generating output signals different in phase as the permanent magnet placed on the float member moves, the mode shown in FIG. 6 is effective. This configuration is shown schematically in FIG. 8. That is, on the side wall of the subtank 7, two hall devices 33*a* and 33*b* are placed along the moving path of the permanent magnet placed on the float member. According to the mode, taking a state in which the subtank is replenished with ink as an example, as the float member moves (rises) in the anti-gravity direction following replenishing with ink, first a large magnetic force acts on the second hall device 33*b* and if replenishing with ink is further continued, large magnetic force acts on the first hall device 33*a*.

Therefore, outputs of the hall devices 33*a* and 33*b* are converted into binary signals based on a predetermined threshold voltage, combinations of (00), (01), (11), and (10) can be provided and it is made possible to recognize the ink amount in the subtank with good accuracy. For example, if the ink amount in the subtank is gradually decreased by the print operation, it can also be recognized with good accuracy.

Figure 8:
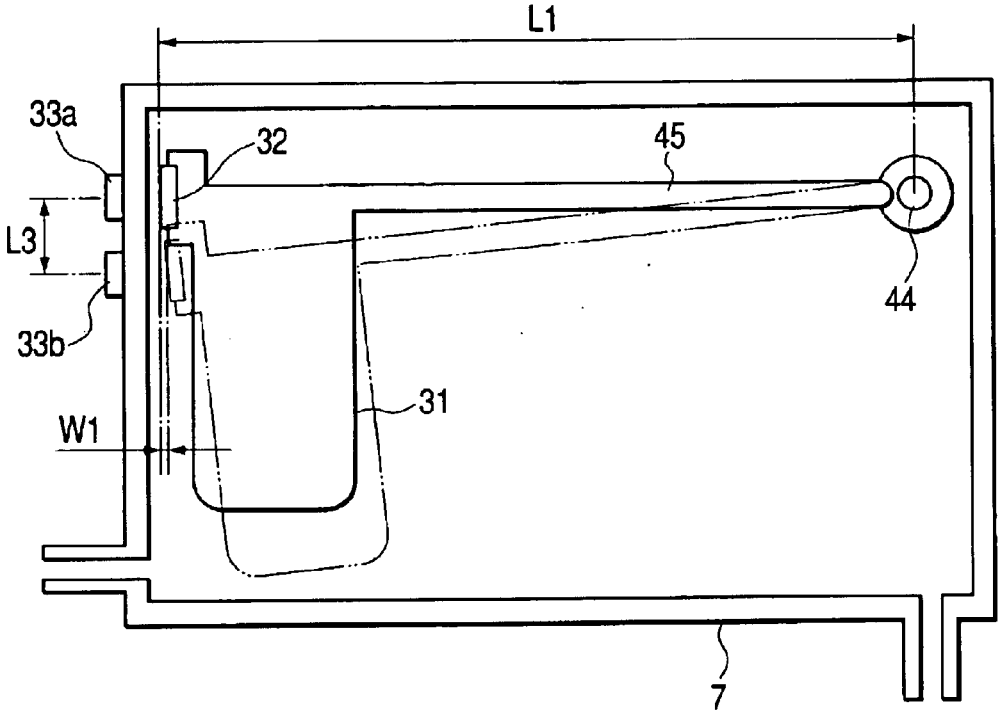
FIG. 8 is a schematic drawing to examine the relationship of the ink amount detection accuracy in the subtank with the distance between a pivotal center of the float member and the permanent magnet.
Figure 9:
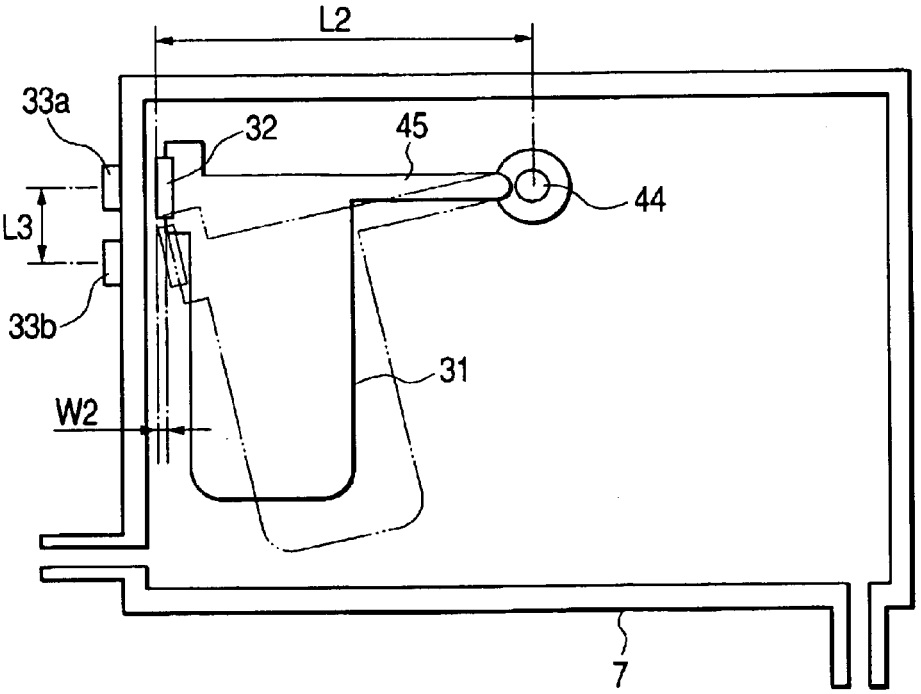
FIG. 9 is a schematic drawing to examine the relationship of the ink amount detection accuracy in the subtank if the distance between the pivotal center of the float member and the permanent magnet is shortened.

FIG. 9 examines the relationship of the ink amount detection accuracy in the subtank with the distance between the pivotal center of the float member 31 and the permanent magnet in the above-described configuration shown in FIG. 8. That is, in FIG. 8, the distance between pivotal center 44 of the float member and the permanent magnet 32 is shown as L1 and in FIG. 9, the distance is shown as L2.

In the modes shown in FIGS. 8 and 9, the distance between the center parts of the hall devices 33*a* and 33*b* is shown as L3. In both the configurations, for example, if L1 is 50 mm and L2 is 25 mm and L3 is 5 mm, comparison of the detection accuracy between the first and second hall devices 33*a* and 33*b* is as follows:

In the configuration shown in FIG. 8, the difference between the distance between the permanent magnet 32 and the first hall device 33*a* when the permanent magnet 32 faces the first hall device 33*a* and the distance between the permanent magnet 32 and the second hall device 33*b* when the permanent magnet 32 faces the second hall device 33*b*, namely, W1 shown in FIG. 8 becomes 0.25 mm.

On the other hand, in the configuration shown in FIG. 9, the difference between the distance between the permanent magnet 32 and the first hall device 33*a* when the permanent magnet 32 faces the first hall device 33*a* and the distance between the permanent magnet 32 and the second hall device 33*b* when the permanent magnet 32 faces the second hall device 33*b*, namely, W2 shown in FIG. 9 becomes 0.51 mm.

As the widths of the W1 and W2 are larger, variations occur in detection in the first and second hall devices 33*a* and 33*b* and particularly, to detect the ink amount in the subtank in the four-combination state resulting from converting the outputs of the hall devices 33*a* and 33*b* into binary signals based on the predetermined threshold voltage as described above, it is ideal that the W1 and W2 are nearer to zero.

According to the examinations, it is desirable to set so that the distance between the pivotal center of the float member 31 and the permanent magnet 32 becomes longer as shown in FIG. 8, and therefore preferably the placement position of support shaft 44 for supporting the float member 31 for rotation is formed in the proximity of an end part in a horizontal direction in the subtank 7.

As seen from the description above, the recording apparatus comprises the float member 31 housed in the subtank 7 and floating up in accordance with ink stored in the subtank 7, the magnetoelectric device 33 (33*a*, 33*b*) as an output generator for generating electric output following the float position of the float member 31 responsive to the ink amount in the subtank 7, and the ink replenishing valve 26 as supply controller for controlling the amount of ink supplied to the subtank in accordance with the electric output provided by the output generator, and thus the subtank 7 is replenished with ink in succession from the main tank 9 in response to the ink storage amount in the subtank 7. Therefore, a proper amount of ink is stored in the subtank while print is continued, so that it is made possible for even a recording apparatus with a long scanning distance capable of printing on a large-scaled paper face, for example, to stably execute print without degrading throughput.

In the ink amount detector realized by the float member 31 in the subtank, it is desired that the detection level of an ink-low state should be set so that ink remains in the subtank as ink is consumed by executing one cleaning operation. The detection level of the ink-low state is thus set, whereby if the cleaning operation is executed, for example, just before the ink amount detector detects the ink-low state, the subtank can be prevented from becoming empty of ink.

Figure 10B:
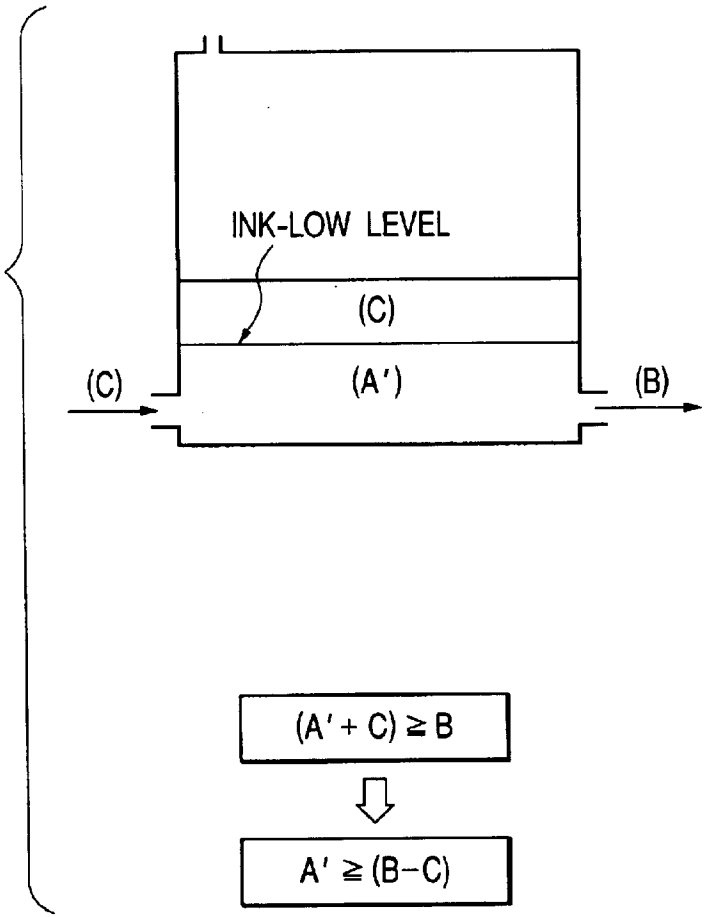
FIGS. 10A and 10B are schematic drawings to show preferred ink amount detection levels when an ink-low state condition is detected by an ink amount detector placed in the subtank.
Figure 10A:
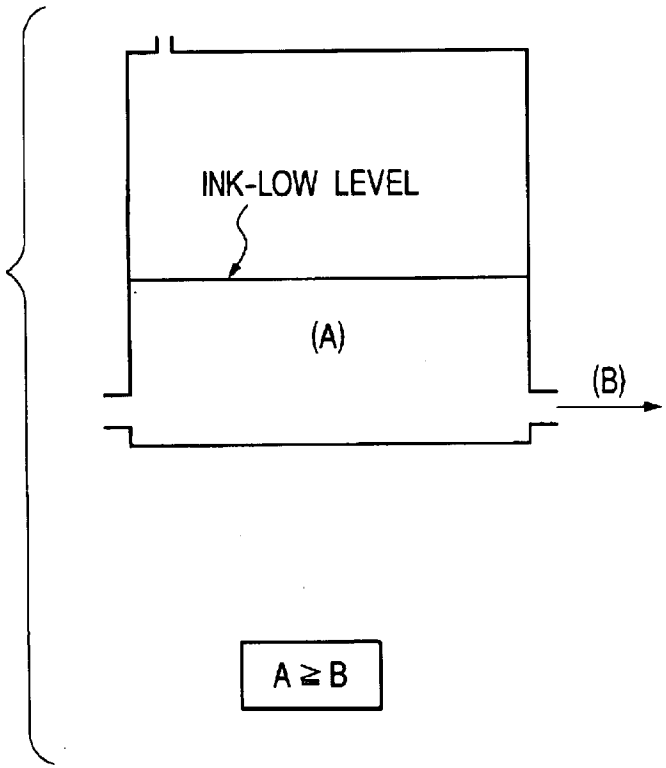

A concept as shown in FIGS. 10A and 10B can be adopted as a method of setting the ink-low state detection level. FIGS. 10A and 10B schematically show the state of the subtank in an ink-low state condition. First, FIG. 10A shows a state in which the ink volume in the subtank corresponding to a predetermined value (ink-low state) detected by the ink amount detector is set to an amount equal to or greater than the amount of ink consumed by one cleaning operation. In this case, the remaining ink amount in the subtank at the ink-low state detection level is shown as (A). Letting the amount of ink consumed by one cleaning operation be (B), if the ink-low state level is set so that the relation of $A \geqq B$ is set, the subtank can be prevented from becoming empty of ink if the cleaning operation is executed just before the ink amount detector detects the ink-low state.

Next, FIG. 10B shows a state in which the ink volume in the subtank corresponding to a predetermined value (ink-low state) detected by the ink amount detector is set to an amount equal to a greater than the amount resulting from subtracting the amount of ink with which the subtank is replenished during the cleaning operation from the amount of ink consumed by one cleaning operation. In this case, the remaining ink amount in the subtank at the ink-low state detection level is shown as (A'). The amount of ink consumed by one cleaning operation is (B). However, if the cleaning operation is executed and the ink amount detector detects the ink-low state, the ink replenishing valve 26 is opened and thus the subtank is replenished with the ink amount shown an (C) during the cleaning operation.

Therefore, if the ink-low state level is set so that the relation of $(A'+C) \geqq B$ is satisfied, the subtank can be prevented from becoming empty of ink if the cleaning operation is executed just before the ink amount detector detects the ink-low state. In other words, the relation of $A' \geqq (B-C)$ as mentioned above is satisfied. Thus, the ink-low state level detected by the ink amount detector can be set to a lower level than that shown in FIG. 10A, and it is also made possible to design the capacity of each subtank mounted on the carriage as a small size.

Figure 11:
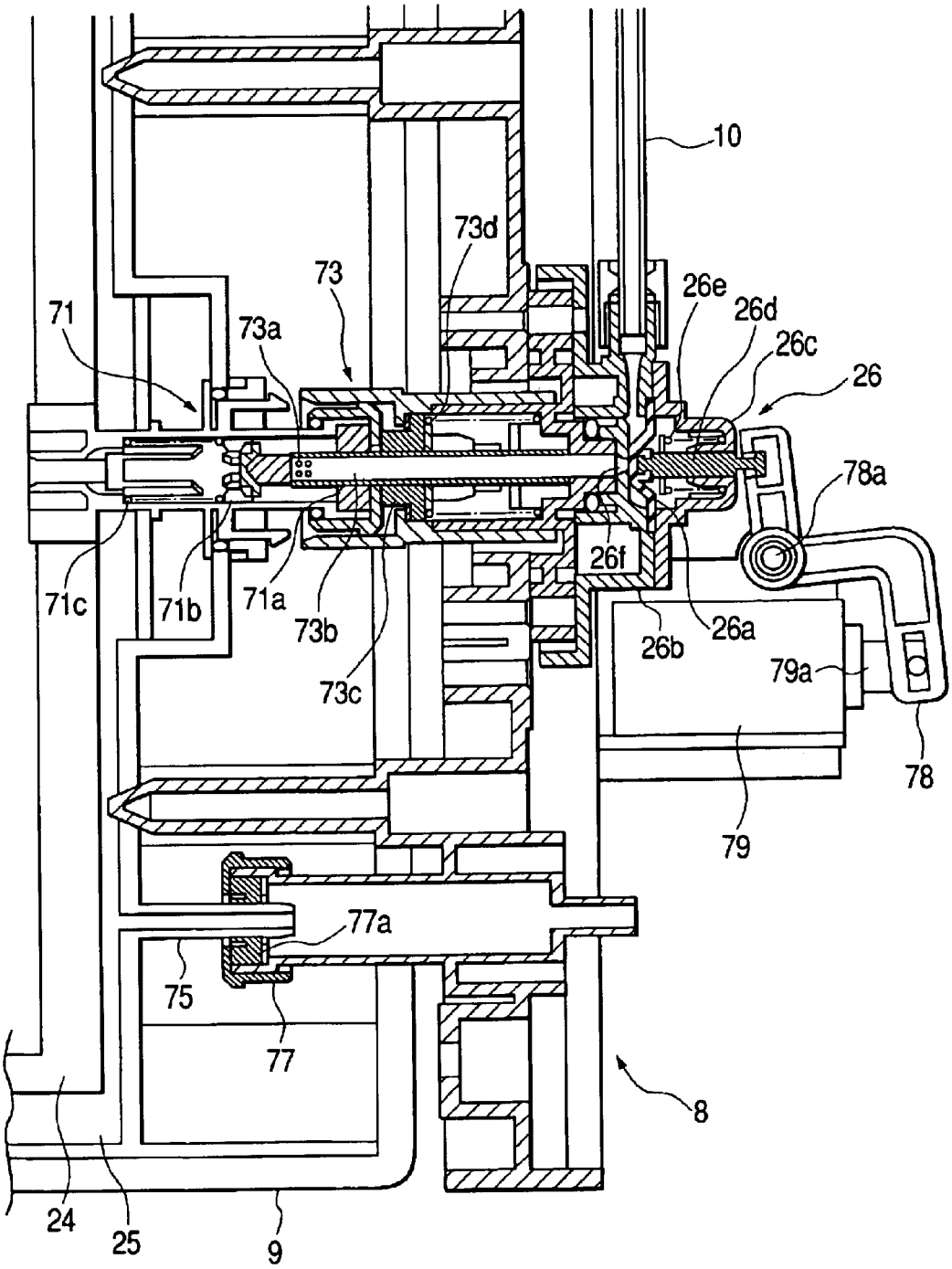
FIG. 11 is a sectional view to show a part of the main tank and a cartridge holder in a state in which an ink replenishing valve is closed.
Figure 12:
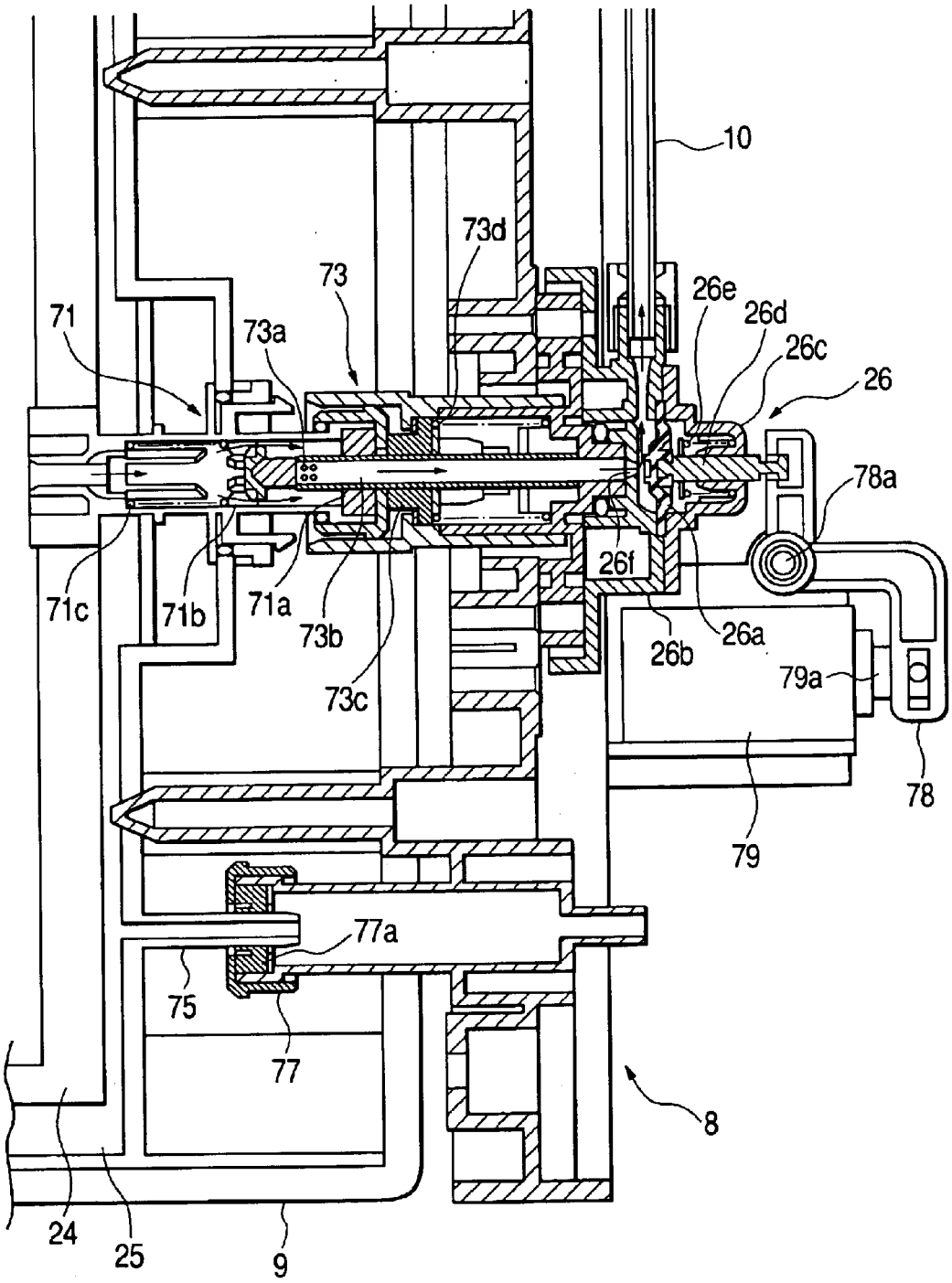
FIG. 12 is a sectional view to show a part of the main tank and the cartridge holder in a state in which the ink replenishing valve is opened.

Next, the placement state of the main tanks in the cartridge holder 8 and the ink replenishing value will be discussed in detail with reference to FIGS. 11 and 12. FIGS. 11 and 12 are sectional views to show a part of the main tank 9 and a part of the cartridge holder 8 on an enlarged scale in the state in which the main tank 9 is an ink cartridge mentioned above in the cartridge holder 8. FIG. 11 shows a state in which the ink replenishing valve 26 placed in the cartridge holder 8 is closed, and FIG. 12 shows a state in which the ink replenishing valve 26 is opened; parts corresponding to the parts previously described are denoted by the same numerals.

An ink tap 71 is formed integrally with the ink pack 24 stored in the main tank 9 and is attached so as to project from one end part of the main tank 9 to the outside. A packing member 71*a* formed like a ring is placed at the tip part of the ink tap 71 and a valve member 71*b* placed slidably in an axial direction in the ink tap 71 is urged to the side of the packing member 71*a* by a spring 71*c*.

According to the configuration, if the main tank 9 is not placed in the cartridge holder 8, the valve member 71*b* abuts the packing member 71*a* so that leaking out ink from the ink pack 24 can be blocked. In the state shown in the figure, the valve member 71*b* is pushed in by a hollow needle described later and ink can be derived from the ink pack 24.

On the other hand, a connection plug 73 is formed to project at the center of the cartridge holder 8. A hollow needle 73*b* formed with an ink inlet hole 73*a* in the vicinity of the tip part is placed in the connection plug 73 and further a slider 73*c* placed slidably in the axial direction is provided so as to surround the outer periphery of the hollow needle 73*b*. The slider 73*c* is urged so as to forward project by a spring 73*d*.

According to the configuration, if the main tank 9 is not placed in the cartridge holder 8, the slider 73*c* closes the ink inlet hole 73*a* made in the hollow needle 73*b* to close the valve. In the state shown in the figure, the slider 73*c* is pushed in by the connection plug 73 in the cartridge holder 8, the ink inlet hole 73*a* in the hollow needle 73*b* is exposed, and ink can be introduced into the hollow needle 73*b* from the main tank 9.

The outer hull member of the main tank 9 is formed with an inlet port 75 formed of a tubular body communicating with the air chamber (pressure chamber) 25. On the other hand, a compressed air supply plug 77 is disposed in the cartridge holder tank 8 and an annular packing member 77*a* is placed in the compressed air supply plug 77. Therefore, in the state shown in the figure in which the main tank 9 is placed in the cartridge holder 8, the annular packing member 77*a* placed in the cartridge holder 8 is brought into intimate contact with and is coupled with the outer peripheral surface of the inlet port 75 formed of a tubular body. Accordingly, the compressed air can be introduced into the air chamber (pressure chamber) 25 of the main tank 9.

The ink replenishing value 26 is disposed at a base end part of the hollow needle 73*b* disposed in the cartridge holder 8 and the ink replenishing tube 10 is connected via the valve 26, so that the subtank 7 mounted on the carriage 1 can be replenished with ink as described above. (Reference numerals 1 and 7 are shown in FIG. 1.)

The ink replenishing valve 26 comprises a diaphragm valve 26*a* and its peripheral margin part is sandwiched between a first case 26*b* and a second case 26*c* and the diaphragm valve 26*a* is housed in both the cases. A slide shaft 26*d* attached to almost the center of the diaphragm valve 26*a* is attached slidably in the axial direction to the second case 26*c*. The slide shaft 26*d* receives a driving force produced by an electromagnetic plunger 79 as an actuator and is driven in a horizontal direction as shown in the figure. Therefore, upon reception of the axial driving force of the slide shaft 26*d*, almost the center of the diaphragm valve 26*a* is moved in the horizontal direction.

In the embodiment, the driving force produced by the electromagnetic plunger 79 is transmitted to one end part of a driving lever 78 pivoted via a support shaft 78*a* and is transmitted to the slide shaft 26*d* capable of driving the diaphragm valve 26*a* at an opposite end part of the drive lever.

Further, a spring 26*e* is placed between the slide shaft 26*d* and the second case 26*c* and when the electromagnetic plunger 79 is in a non-activated state, as shown in FIG. 11, the center of the diaphragm valve 26*a* closes an opening part 26*f* made in the first case 26*b* connected to the base end part of the hollow needle 73*b* to close the valve by the urging force of the spring 26*e*. When the electromagnetic plunger 79 is activated, as shown in FIG. 12, a driving rod 79*a* of the electromagnetic plunger 79 is pulled in, whereby the slide shaft 26*d* is pulled out via the driving lever 78. Therefore, the center of the diaphragm valve 26*a* leaves the opening part 26*f* made in the first case 26*b* and is opened.

Therefore, in the open state of the diaphragm valve 26*a* as the electromagnetic plunger 79 is activated, ink is introduced from the ink pack 24 into the first case 26*b* in which the diaphragm valve is placed via an ink flow passage provided by the hollow needle 73*b* as indicated by the arrow in FIG. 12, and the subtank 7 can be replenished with ink via the ink replenishing tube 10 connected to the first case 26*b*. When the amount of ink in the subtank 7 reaches the predetermined volume, the electromagnetic plunger 79 is not activated and replenishing with ink is stopped according to output of the hall devices 33*a* and 33*b* for detecting the magnetic flux density change of the permanent magnet 32 following the float position of the float member 31 placed in the subtank 7.

If the operation power of the recording apparatus is turned off, the electromagnetic plunger 79 is also placed in a non-activated state, whereby the center of the diaphragm valve 26*a* closes the opening part 26*f* made in the first case 26*b* connected to the base end part of the hollow needle 73*b* to close the valve by the urging force of the spring 26*e*, as shown in FIG. 11. Therefore, if a water head difference exists between the main tank 9 and the subtank 7, ink flowing in either direction via the ink replenishing tube 10 can be blocked.

As understood from the configuration shown in FIGS. 11 and 12, the ink flow passage to the opening part 26*f* of the first case 26*b* in which the diaphragm valve 26*a* is placed, namely, the ink flow passage formed in the hollow needle 73*b* and the ink flow passage from the inside of the case 26*b* to the ink replenishing tube 10 are made almost orthogonal to each other and the derivation part of the ink replenishing tube 10 connected to the case 26*b* is placed so as to head for almost in a vertical direction.

According to the configuration, air bubbles entered when the main tank 9 as an ink cartridge is placed in the cartridge holder 8 can be floated toward the ink replenishing tube 10 side without building up in the vicinity of the diaphragm valve 26*a*. The air bubbles floated toward the ink replenishing tube 10 side are introduced into the subtank 7 and are floated, so that a problem of the air bubbles entering the recording head 6 and causing a print failure to occur can be circumvented.

In the embodiment shown in FIGS. 11 and 12, the ink replenishing valve comprising the diaphragm valve 26*a* is placed in the cartridge holder 8 in which the main tank is placed. That is, the ink replenishing valve is placed in the close vicinity of the main tank side in the ink replenishing passage from the main tank to the subtank. For example, if the main tank 9 is drawn out from the cartridge holder 8, leaking out ink existing in the ink replenishing tube 10 to the cartridge holder 8 side can be effectively blocked because the ink replenishing valve is placed in the close vicinity of the cartridge holder 8.

In this case, although the cartridge holder 8 comprises the slider 73*c* for covering the ink inlet hole 73*a* of the hollow needle 73*b* to close the valve, placing the ink replenishing valve in the close vicinity of the main tank side can contribute to more effective blocking of leaking out ink from the connection plug 73 in the cartridge holder upon reception of a backward flow caused by the water head difference, because the valve closing function of the ink inlet hole 73*a* by the slider 73*c* and the valve closing function by the ink replenishing value 26 work as a synergistic effect.

Since the recording apparatus is configured as described above, ink is always pushed out by compressed air from the main tank to the subtank during the operation of the recording apparatus. The amount of ink in the subtank is detected by the ink amount detector and opening and closing the ink replenishing valve placed in the ink replenishing passage from the main tank to the subtank are controlled by control signals provided by the ink amount detector, whereby necessary and sufficient ink can always be stored in the subtank.

That is, the recording apparatus comprises the ink amount detector for detecting the amount of ink stored in the subtank and the ink replenishing controller being placed in the ink replenishing passage between the main tank and the subtank for controlling replenishing the subtank with ink from the main tank in response to the ink amount detection state of the ink amount detector and thus the subtank is always replenished with ink, for example, even during printing and a proper amount of ink can be held in the subtank. Therefore, for example, if the recording apparatus is adopted as a large-sized recording apparatus using a recording head with a large number of nozzles and having a carriage with a long scanning distance, stable print operation can be executed without degrading throughput. According to the ink jet recording apparatus adopting the ink replenishing method, air pressure is applied to the main tank by the compressor unit so as to control the opening/closing of the ink replenishing valve placed in the ink replenishing passage between the main tank and the subtank, in response to the detection state of the amount of ink stored in the subtank. Thus, in addition to the above-described technical advantage, the replenishing operation of each subtank with ink can be performed promptly and the amount of ink in each subtank can always be managed in a proper state.

The ink supply valve closed when the operation power of the recording apparatus is off is placed in the ink supply passage from the main tank as an ink cartridge to the subtank mounted on the carriage. Thus, during the non-operating period of the recording apparatus or at the time of an unexpected power outage, ink flowing in either direction because of the water head difference between the main tank and the subtank can be blocked and the recording apparatus not polluting the machine with leaked ink can be provided.

For example, if the ink amount detector containing the float member malfunctions or some failure occurs in the control signal transmission system from the ink amount detector to the ink replenishing valve in the ink jet recording apparatus configured as described above, an accident occurs in which the ink replenishing valve is not closed although the subtank is replenished with a predetermined amount of ink. If such an accident occurs, the following problem can occur: The subtank is continuously replenished with ink from the main tank by the compressed air and ink leaks via the atmospheric release port 7*e* formed in the subtank or the like, polluting the surroundings.

Figure 13:
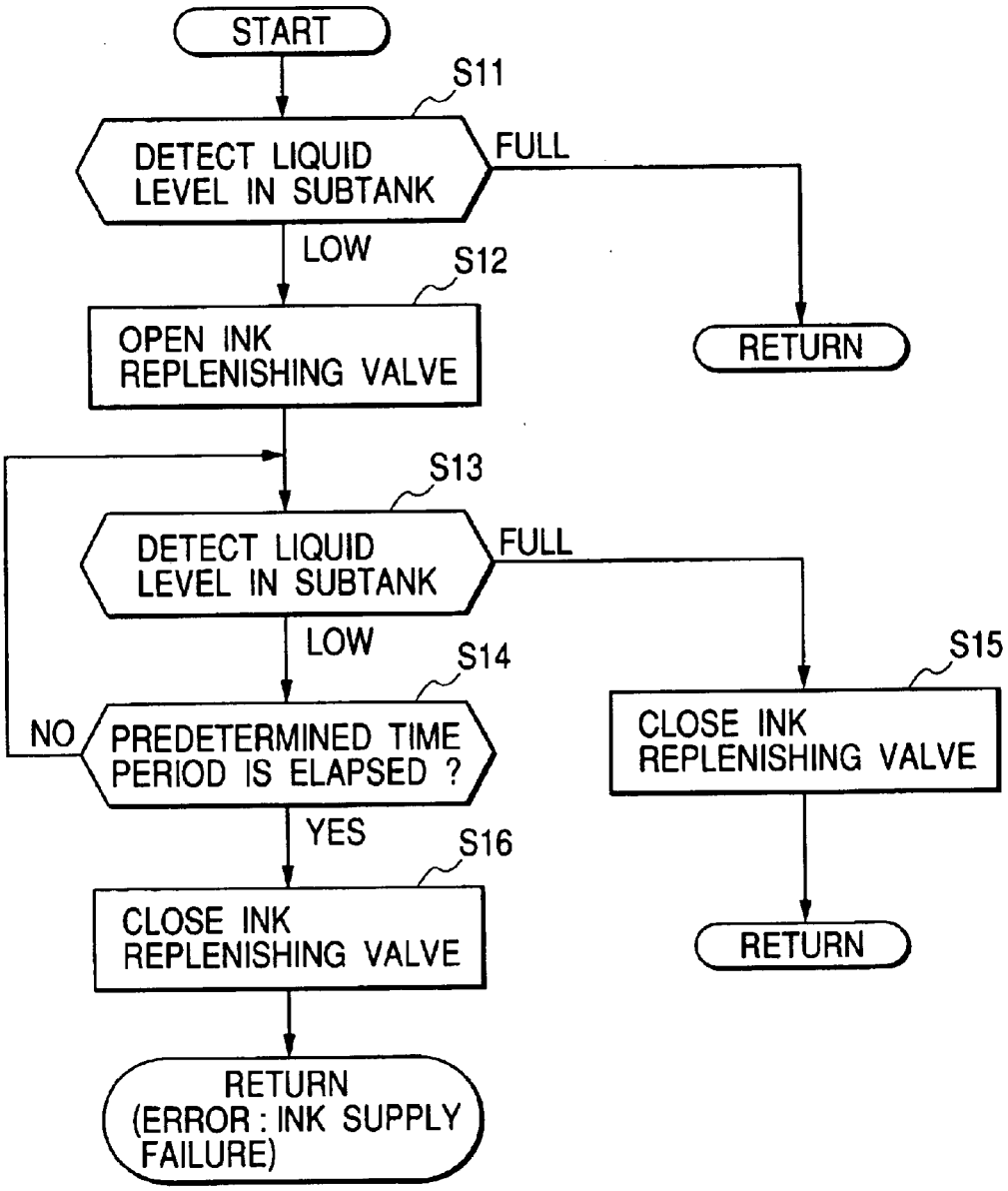
FIG. 13 is a flowchart to show an ink replenishing control routine of the subtank from the main tank, executed in the recording apparatus.

Then, a control routine of replenishing the subtank with ink intended so as to prevent such a problem of leaking ink from the subtank, for example, assuming the accident as described above will be discussed with reference to FIG. 13. The replenishing operation of the subtank with ink will be discussed according to the control routine shown in FIG. 13.

First, at step S11, ink level detection in the subtank is executed. It is determined by output of the hall devices 33*a* and 33*b* for detecting the magnetic flux density of the permanent magnet attached to the float member as described above.

Here, if the ink amount detector determines that the amount of ink in the subtank is less than a predetermined value, the case is called "LOW" and if the ink amount detector determines that the amount of ink in the subtank reaches a sufficient amount, the case is called "FULL." If the ink amount is determined "FULL" at step S11, a return mode is entered and subsequently the ink amount is monitored at step S11. If the ink amount is determined "LOW" as the recording head consumes ink, control goes to step S12 and the ink replenishing valve 26 is opened.

Therefore, replenishing the subtank with ink from the main tank is started (ink replenishing step). Subsequently, the ink amount detector monitors the ink amount in the subtank as shown at step S13. Just after the replenishing valve 26 is opened at the step S12, normally the "LOW" state is detected at step S13 and determination shown at step S14 is made.

That is, at step S14, the elapsed time since the ink replenishing valve opening operation executed at step S12 is determined and if the elapsed time is less than a predetermined time period, control returns to step S13 and ink level detection in the subtank is executed, namely, the ink amount detector monitors the control output. The loop returning to step S13 from step S14 mentioned above is repeated.

In the state in which the elapsed time is less than the predetermined time period, the subtank is replenished with ink and if the ink amount is determined "FULL" at step S13, control goes to step S15 at which the ink replenishing valve 26 is closed and a return mode is entered (ink replenishment stopping step). Therefore, the operation shown at steps S11 to S15 is repeated and the subtank is intermittently replenished with ink from the main tank. The operation shown at steps S11 to S15 is repeated when the ink replenishing operation is performed normally.

Here, for example, if the float member 31 forming a part of the ink amount detector undergoes some failure and does not float up, for example, although the subtank is replenished with a sufficient amount of ink, the subtank is continuously replenished with an excessive amount of ink. A similar accident also occurs if an unexpected failure occurs in the control signal transmission system from the ink amount detector to the ink replenishing valve. Consequently, a problem of ink overflowing the subtank occurs.

The routine shown at the step S14 and step S16 following the step controls so as to prevent the subtank from being replenished with an excessive amount of ink assuming occurrence of such a failure. That is, at step S14, the elapsed time period since the ink replenishing valve opening executed at step S12 is monitored as described above, and if it is determined in the loop operation of steps S13 and S14 that "FULL" is not detected, namely, the "LOW" state remains although the predetermined time period has elapsed, control goes to step S16 and the ink replenishing valve 26 is forcibly closed (ink replenishment forcibly stopping step).

In such a state, it can be assumed that some failure occurs in the ink replenishing system as described above and therefore the valve is forcibly closed automatically because of the expiration of the predetermined time period managed at step S14, whereby replenishing the subtank with excessive ink can be stopped. If control goes to step S15, it is desired that error display indicating the ink supply failure state should be produced for informing the user that trouble in the ink replenishing system occurs.

According to the described configuration, for example, when a failure such that a predetermined air pressure is not applied to the air chamber (pressure chamber) 25 of the main tank or such that ink is hard to flow in the tube 10 forming the ink replenishing passage from the main tank to the subtank occurs, error display can also be produced, in which case a print failure can occur and anyway the user can be informed of the necessity for maintenance.

As seen from the description made above, the ink jet recording apparatus adopting the ink replenishing control method comprises the controller for forcibly closing the ink replenishing valve placed in the ink replenishing passage from the main tank as an ink cartridge to the subtank if the predetermined time period has elapsed after the ink replenishing valve was opened, so that the problem of polluting the machine with leaked ink, etc., in the recording apparatus using this kind of ink supply system for pressurizing the main tank can be solved.

Next, a second embodiment comprising ink end detector for checking whether or not an ink cartridge of a main tank is in an ink end condition will be discussed with reference to FIGS. 14 to 20. Members corresponding to those previously described with reference to FIGS. 1 to 13 are denoted by the same reference numerals in FIGS. 14 to 20 and will not be discussed again in detail.

Figure 14:
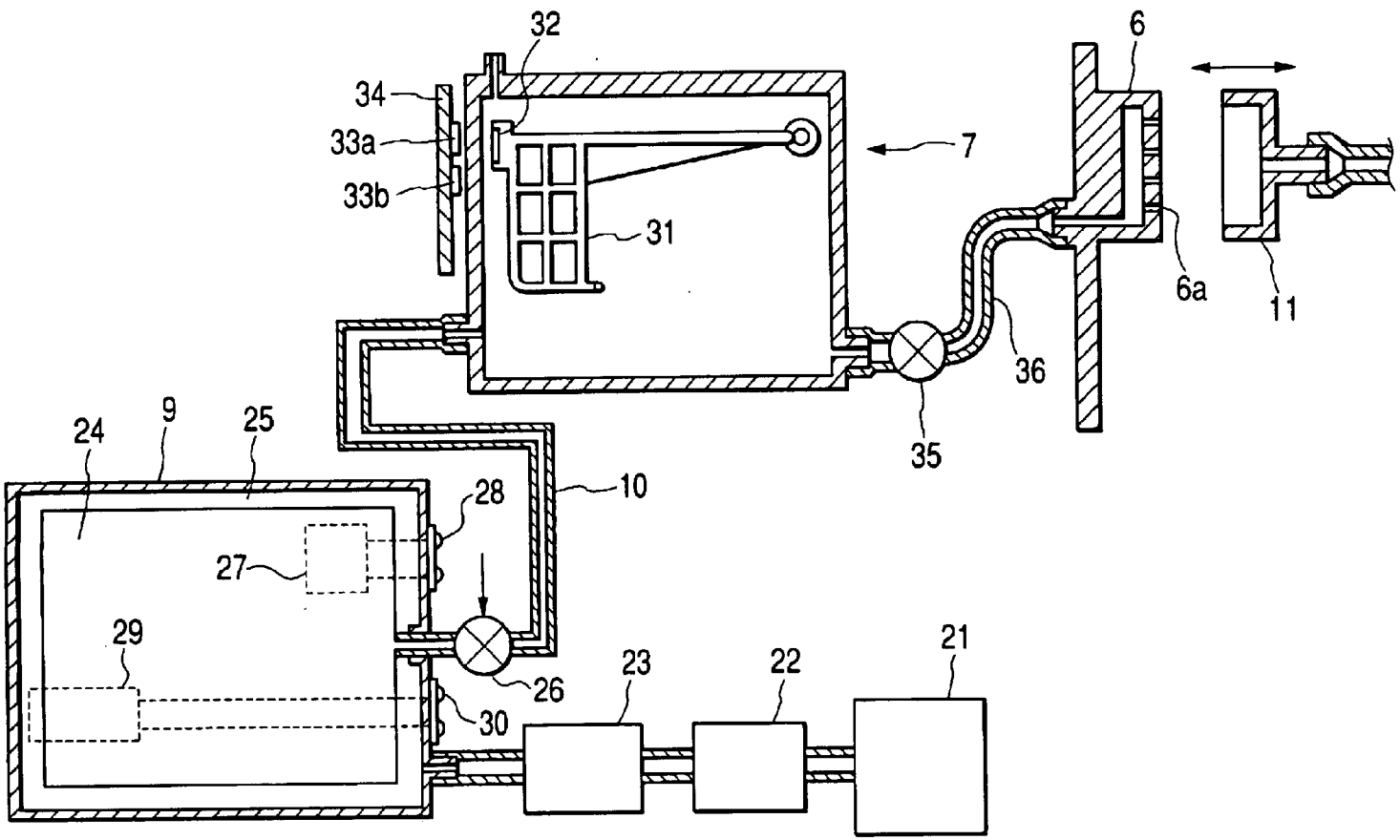
FIG. 14 is a schematic drawing to show an ink supply system from the main tank to the recording head, according to a second embodiment of the invention.
Figure 15:
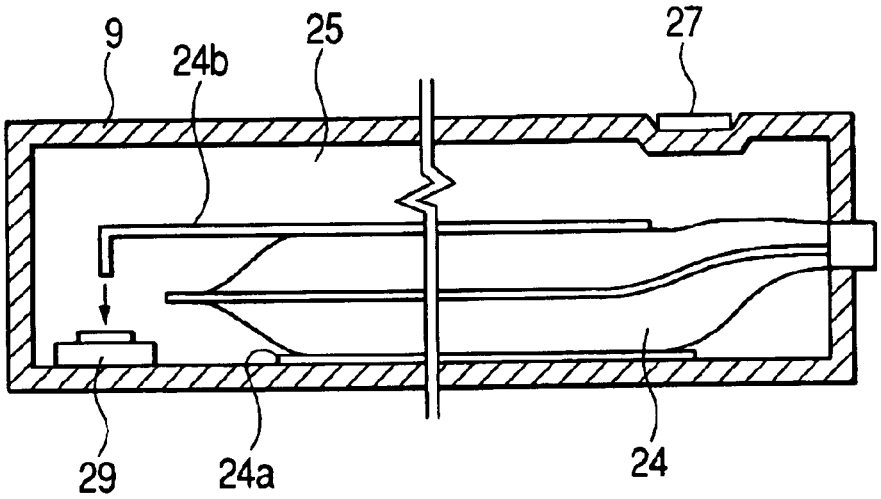
FIG. 15 is a sectional view to show the configuration of an ink cartridge shown in FIG. 14.

In the main tank 9 as an ink cartridge, a memory 27 capable of recording information concerning the main tank 9 is placed in a part of a case of the main tank as also shown in FIG. 15, and data concerning the residual ink amount in the main tank is written into the memory 27 as described later. As shown in FIG. 14, a terminal 28 for writing or reading information into or from the memory 27 is placed on a part of the main tank 9, and when the main tank 9 is placed in a recording apparatus, the terminal is electrically connected to the recording apparatus and information concerning the residual ink amount in the main tank is transferred.

A detection switch 29 forming an ink end detector for detecting the amount of ink stored in the main tank becoming a predetermined value or less may be provided in the main tank 9 as also shown in FIG. 15. One face of the ink pack 24 is put on the inner face of the case forming the main tank 9, for example, with a double-faced adhesive sheet and an actuation plate 24*b* is put on another face of the ink pack 24 in a similar manner. According to the configuration, if the amount of ink sealed in the ink pack 24 becomes low, a part of the actuation plate 24*b* functions so as to turn on the detection switch 29, for example, as the ink pack 24 contracts.

As show in FIG. 14, a terminal 30 where on/off information of the switch 29 is derived is placed on a part of the main tank 9 and when the main tank 9 is placed in the recording apparatus, the terminal can be electrically connected to the recording apparatus.

On the other hand, in the embodiment, a consumed ink amount calculator for calculating the consumed ink amount in a subtank as described later is provided, and if the calculator determines that ink consumption in the subtank exceeds a predetermined amount, the ink replenishing valve 26 is opened. Thus, ink compressed in the main tank 9 is separately sent to the subtank 7 where ink consumption exceeds the predetermined amount.

If the residual ink amount in the subtank 7 reaches a predetermined volume, the ink replenishing valve 26 is closed based on output of ink amount detector containing the float member as described above. Such a sequence is repeated, whereby the subtank is intermittently replenished with ink from the main tank and ink in a constant range is always stored in each subtank.

Figure 16:
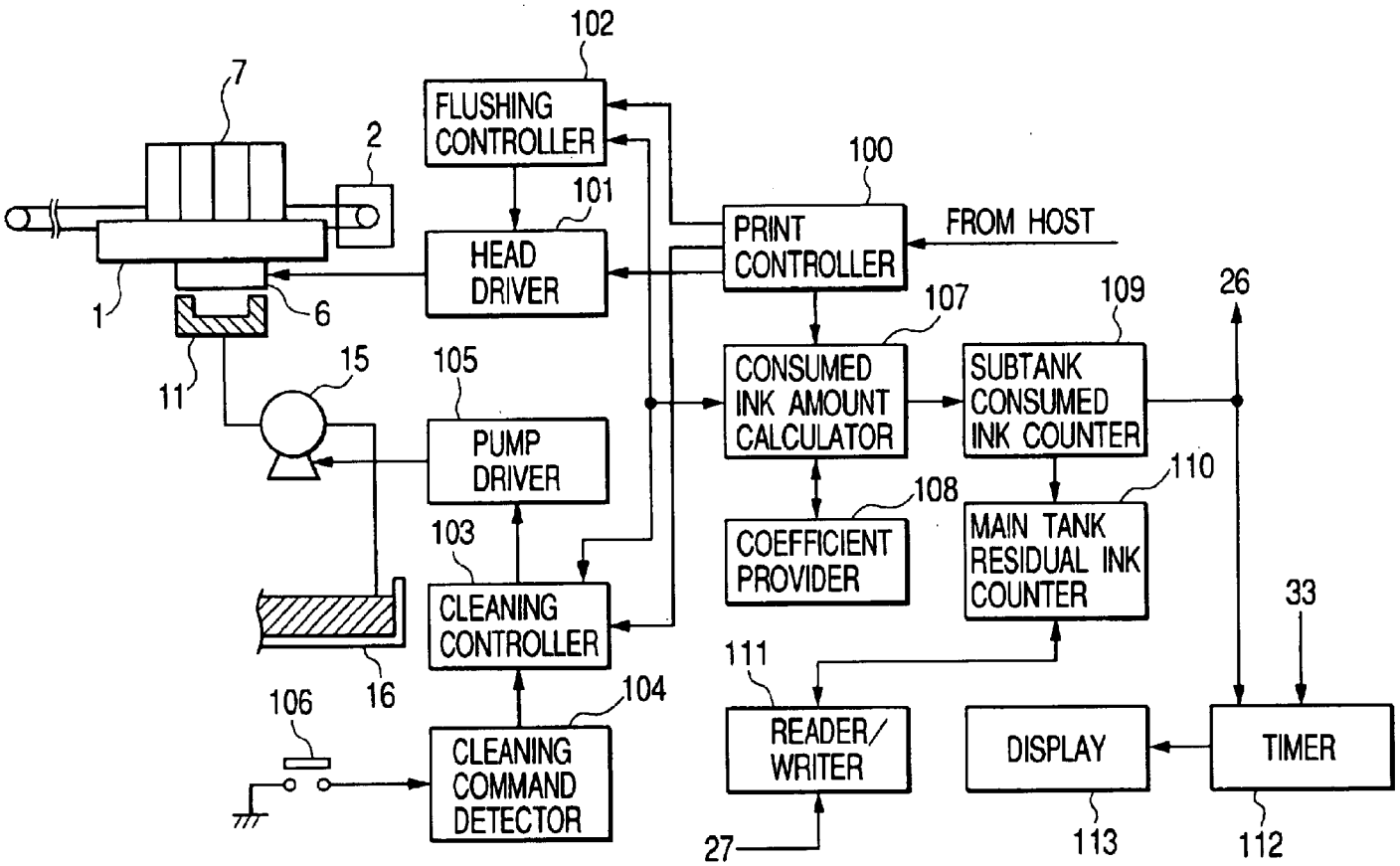
FIG. 16 is a block diagram to show the configuration of a control circuit installed in the ink jet recording apparatus.

FIG. 16 shows an example of a control circuit forming an ink end detector of a cartridge, installed in the recording apparatus according to the second embodiment. Parts corresponding to those previously described are denoted by the same reference numerals in FIG. 16, and therefore will not be discussed again. As shown in FIG. 16, the suction pump 15 is connected to capping unit 11 and the discharge side of the suction pump 15 is connected to a waste ink tank 16.

In FIG. 16, a print controller 100 has a function of generating bit map data based on print data from a host computer, and causing a head driver 101 to generate a drive signal based on the data for ejecting ink through the recording head 6 mounted on the carriage 1. Upon reception of a flushing command signal from a flushing controller 102, the head driver 101 also outputs a drive signal for the flushing operation to the recording head 6 in addition to the drive signal based on the print data.

A cleaning controller 103 has a function of controlling a pump driver 105 for driving the suction pump 15 upon reception of a control signal from a cleaning command detector 104. A cleaning command switch 106 placed on an operation panel, etc., of the recording apparatus is operated, whereby the cleaning command detector 104 operates and manual cleaning operation is executed.

The cleaning controller 103 also receives a control signal from the print controller 100 and comprises a cleaning operation function of controlling the pump driver 105 for driving the suction pump 15 according to the received control signal.

On the other hand, each of the print controller 100, the flushing controller 102, and the cleaning controller 103 supplies a control signal to a consumed ink amount calculator 107. The consumed ink amount calculator 107 has a function of calculating the consumption amount of ink stored in each subtank 7. The number of ink drops ejected through the recording head by the print controller 100 based on the print data and the number of ink drops ejected through the recording head by the flushing operation of the flushing controller 102, and data whenever the cleaning operation of sucking and discharging ink from the recording head by the cleaning controller 103 is executed are supplied to the consumed ink amount calculator 107.

The consumed ink amount calculator 107, which receives the data, accesses a coefficient provider 108 based on the number of ink drops ejected through the recording head by execution of print, the number of ink drops ejected through the recording head by the flushing operation, and ink discharge processing each time the cleaning operation is executed and multiplies the data by a coefficient corresponding to each, thereby calculating the consumption amount of ink in the subtank 7.

The consumption amount of ink in the subtank 7 thus calculated is sent to a subtank consumed ink counter 109 and is counted up (added). If the count reaches a predetermined numeric value, it means a state in which the ink amount in the subtank 7 is decreased, and therefore the ink replenishing valve 26 is opened so as to replenish the subtank with ink from the main tank.

If the ink volume in the subtank 7 becoming a predetermined value (almost fill-up state) as the subtank is replenished with ink is detected based on electric output of the hall devices 33*a* and 33*b*, the ink replenishing valve 26 is closed as mentioned above, and at the same time, the count of the subtank consumed ink counter 109 is reset.

On the other hand, information of the consumed ink amount in the subtank is transferred from the subtank consumed ink counter 109 to a main tank residual ink counter 110. The data concerning the residual ink amount in the main tank stored in the memory 27 installed in the placed main tank is preset in the main tank residual ink counter 110 through write and read unit 111.

The count of the subtank consumed ink counter 109 just before it is reset is sent to the main tank residual ink counter 110 and the count of the subtank consumed ink counter 109 is subtracted from the count indicating the residual ink amount in the main tank. Accordingly, the main tank residual ink counter 110 is decremented as ink is consumed, and the numeric data is written into the memory 27 through a reader/writer 111. The consumed ink amount calculator 107, the coefficient provider 108, the subtank consumed ink counter 109, and the main tank residual ink counter 110 generally are placed in the recording apparatus, but may be placed in the host computer as required.

A control signal sent to open the ink replenishing valve 26 from the subtank consumed ink counter 109 is supplied to a timer 112. The timer 112 starts to count the time period at the same time as the ink replenishing valve 26 is opened. It receives output of the hall devices 33*a* and 33*b* occurring when the subtank 7 is placed almost in a fill-up state.

Upon reception of the control signal sent to open the ink replenishing valve 26, the timer 112 starts to count the time period, and if the output of the hall devices 33*a* and 33*b* occurring when the subtank 7 is placed almost in a fill-up state does not come although a predetermined time period has elapsed, the timer 112 causes a display 113 to display a message, etc., indicating that the main tank is in an ink end condition.

That is, in the recording apparatus, compressed air is supplied to the inside of the air chamber (pressure chamber) of the main tank and each subtank is replenished with ink from each main tank by the compressed air. Therefore, the time interval between the instant at which replenishing each subtank with ink is started and the instant at which the subtank 7 is placed almost in a fill-up state is found on the design. Thus, if replenishing each subtank with ink is insufficient although the time interval is exceeded largely, it can be estimated that the main tank is in an ink end condition.

If the main tank being in an ink end condition is thus detected, the display 83 is caused to display a message, etc., indicating that the main tank is in an ink end condition, and the print operation of the recording apparatus is stopped. Accordingly, a problem of making also the subtank empty of ink can be circumvented and air bubbles entering the ink supply passage of the recording head can be blocked effectively. Although the display 83 may be placed in the recording apparatus, display of the host computer may be used as required.

At this time, ink in the main tank can be spent until the main tank becomes almost empty of ink, and the running cost and the load of treating the remaining ink in the scrapped ink cartridge, etc., can be decreased.

The ink end information is sent from the timer 112 to the main tank residual ink counter 110 so that an ink end flag which indicates the ink end state is written in the memory 27 mounted on the main tank, via the reader/writer 111. Accordingly, in a case where the main tank is again loaded on the recording apparatus, the ink end state of the main tank can be immediately recognized by reading out the ink end flag.

Here, in a case where the following control method is adopted, the ink end information of the main tank can be substantially written on the memory 27, without utilizing the above ink end flag as the ink end information.

Concretely, when the ink end information is transferred from the timer 112 to the main tank residual ink counter 110, information regarding the residual ink amount or the consumed ink amount is converted into an residual ink value corresponding to the ink end state (e.g., numeric information "0"), or a consumed ink value corresponding to the ink end state (e.g., numeric information "100" if the capacity of the main tank is 100 cc). The converted value is written in the memory 27 via the reader/writer 111.

As a result, when the main tank is again loaded on the recording apparatus, it can be read out that the residual ink amount in the main tank is "0", so that the ink end state of the loaded main tank can be immediately recognized. In a case where the main tank residual ink counter 110 deals with the information regarding the consumed ink amount, the ink end state of the loaded main tank can be immediately recognized if the read out value indicating the consumed ink amount reaches "100".

In the above case where the numeral data in the main tank residual ink counter 110 is incrementally or decrementally controlled by utilizing the function of the consumed ink amount calculator 107, there is probability that the residual ink value reaches "0" even though the main tank is actually in the ink end state, due to a margin of error in the consumed ink amount measured by the consumed ink amount calculator 107. Similarly, there is probability that the consumed ink value reaches "100" which is the capacity of the main tank.

If the numeral data is directly written in the memory 27 under the above condition, the ink end state may be recognized with reference to the written data even though the main tank is not actually in the ink end state.

To solve the above problem, it is preferable to configure the main tank residual ink counter 110 so that the decrement of the count is stopped when the count closes to the value corresponding to the ink end state (e.g., "0"), and so that the counted value is rewritten to "0" when the ink end information is sent from the timer 112. Accordingly, the ink end information can be precisely written in the memory 27 under a condition where the main tank is actually in the ink end state.

Similarly, in a case where the main tank residual ink counter 110 deals with the information regarding the consumed ink amount, it is preferable to configure the main tank residual ink counter 110 so that the increment of the count is stopped when the count closes to the value corresponding to the ink end state. For example, in a case where the value corresponding to the ink end state is "100", the increment of the count is stopped at "99". And main tank residual ink counter 110 is configured so that the counted value is rewritten to "100" when the ink end information is sent from the timer 112.

Accordingly, the ink end information can be precisely written in the memory 27 under a condition where the main tank is actually in the ink end state.

Figure 17:
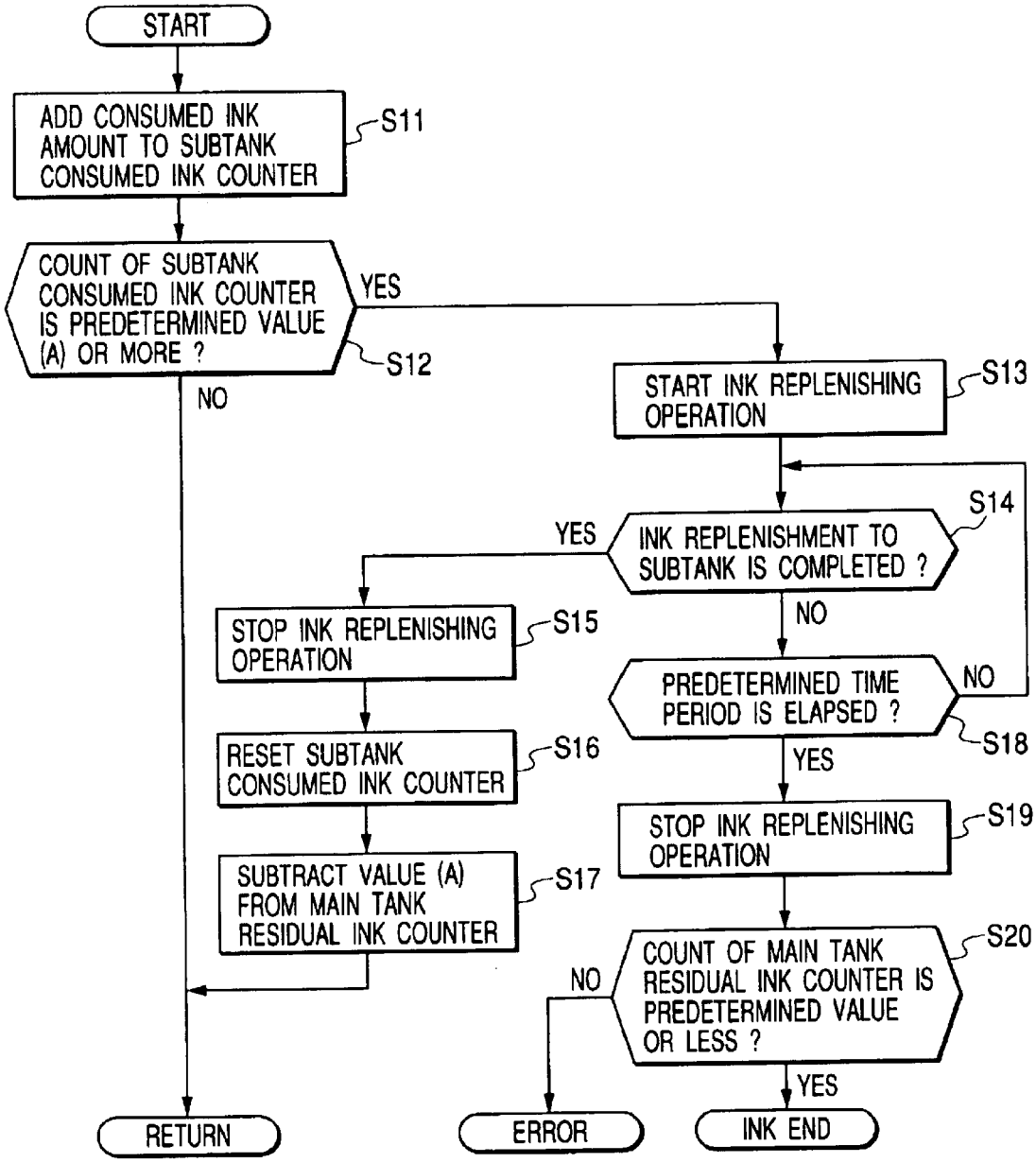
FIG. 17 is a flowchart to show an operation routine for detecting an ink end condition of the cartridge performed by the control circuit shown in FIG. 16.

By the way, according to the main tank ink end detector having the described configuration, for example, if some failure occurs in the ink replenishing passage from the main tank to the subtank or the supply passage of the compressed air, there is a probability that it may be recognized by mistake that the main tank is in an ink end condition. A control routine shown in FIG. 17 is designed so that it can circumvent such a problem. The function of the control routine will be discussed together with the control circuit shown in FIG. 16 with reference to a flowchart indicating the control routine.

To detect an ink end condition of the main tank, first the amount of ink consumed for print, etc., is added to the subtank consumed ink counter as shown at step S11. To do this operation, the consumption amount of ink in the subtank calculated by the consumed ink amount calculator 107 shown in FIG. 16 is sent to the subtank consumed ink counter 109 for adding the consumed ink amount. At step S12, whether or not the subtank consumed ink counter is greater than a predetermined value (A) is checked.

This is to check whether or not the count of the subtank consumed ink counter 109 shown in FIG. 16 exceeds the predetermined value (A). If it is determined that the count does not exceed the predetermined value (A) (No), the ink volume in the subtank has a margin. Therefore, control returns until the count exceeds the predetermined value (A), and the routine at the steps S11 and S12 is repeated. If it is determined at the step S12 that the numeric value of the subtank consumed ink counter 109 exceeds the predetermined value (A), control goes to step S13 and the operation of replenishing the subtank with ink is started. This is performed by opening the ink replenishing valve 26. Subsequently, at step S14, whether or not replenishing the subtank with ink is complete is checked. To do this, output of the hall devices 22*a* and 33*b* is used as described above.

Concurrently with the checking at step S14, checking whether or not the predetermined time period has elapsed since the operation of replenishing the subtank with ink was started is also started at step S18. This is performed by the timer 112 shown in FIG. 16. It is determined that replenishing the subtank with ink is complete before the expiration of the predetermined time period (Yes), the ink replenishing operation is stopped at step S15. This is performed by closing the ink replenishing valve 26 as described above.

At step S16, the subtank consumed ink counter 109 is reset and at step S17 following the step, the value (A) is subtracted from the main tank residual ink counter 110.

Accordingly, the ink amount as much as one replenishing the subtank with ink is subtracted and the subtraction result (in other words, the residual ink amount in the ink cartridge) is set in the main tank residual ink counter 110.

On the other hand, it is determined at the step S14 that replenishing the subtank with ink is not complete (No), and moreover it is determined at step S18 that the predetermined time period has elapsed, it is estimated that the ink cartridge becomes empty of ink. Then, at step S19, the operation of replenishing the subtank with ink is stopped.

Subsequently, at step S20, whether or not the cartridge residual ink amount counter 110 is equal to or less than a predetermined value is determined. If replenishing the subtank with ink is not complete within the predetermined time period although the main tank residual ink counter 110 does not reach the predetermined value or less (No), in other words although a considerable amount of ink is left in the cartridge, it can be assumed that some trouble occurs, for example, in the ink replenishing passage, the supply passage of the compressed air, or the like. In this case, error display is produced on the display 113.

If it is determined at the step S20 that the main tank residual ink amount counter 110 reaches the predetermined value or less (Yes), it is determined that the ink cartridge enters an end condition certainly. In this case, display indicating the ink end is produced on the display 113. That is, the determination at the step S20 is provided, whereby the ink end condition of the main tank can be recognized correctly.

In the embodiment described above, the information of the residual ink amount in the ink cartridge is read from the memory 27 placed in a part of the case forming the main tank as the ink cartridge, and the consumed ink amount in the subtank is subtracted from the information for use as the residual ink amount information of the ink cartridge.

However, the detection switch 29 placed in the ink cartridge, for example, as shown in FIGS. 14 and 15 can be used as means for recognizing the residual amount information of ink in the ink cartridge.

In this case, the residual amount information of ink in the cartridge based on the detection switch 29 is used at step S20 shown in FIG. 17 as information for determining whether the condition is an error or ink end condition.

Pressurized air is introduced into the air chamber (pressure chamber) of the ink cartridge and the subtank is replenished with ink, but the invention can also be used for recording apparatuses other than such a type of recording apparatus. For example, in a recording apparatus for sucking so as to place the inside of a subtank in negative pressure and replenishing the subtank with ink or a recording apparatus for providing a water head difference between an ink cartridge and a subtank for producing an ink flow from the ink cartridge into the subtank, physical detectors as shown in FIGS. 18 to 20 can be used as the residual amount detector of ink in the cartridge.

Figure 18B:
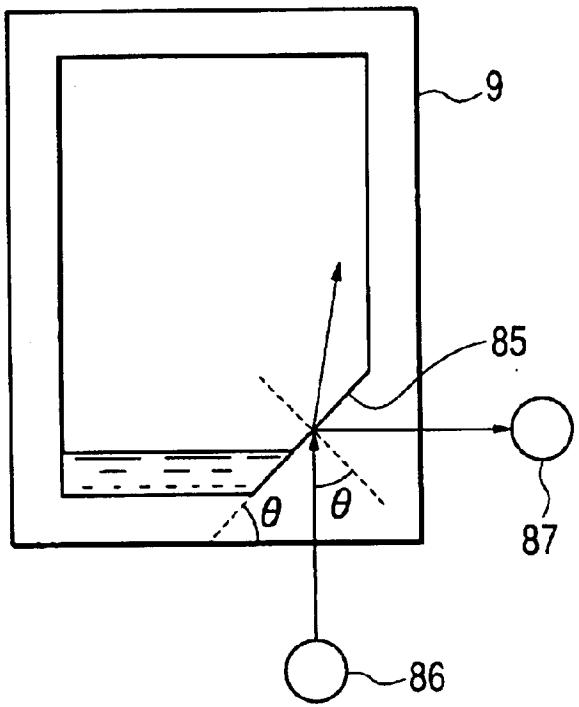
FIGS. 18A and 18B are schematic drawings to show a first example of an ink end detector that can be used in the operation routine for detecting the ink end condition shown in FIG. 17.
Figure 18A:
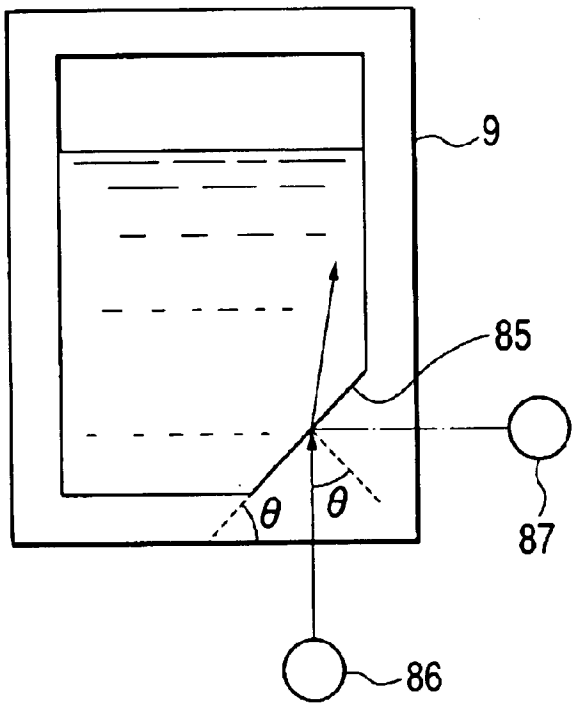

First, FIGS. 18A and 18B show a configuration wherein a case of an ink cartridge 9 is molded of a transparent resin and a prism part 85 is formed at a corner between the lower bottom portion and the side wall portion of the case. That is, the incidence angle on the print part 85 from the light source 86 and the outgoing angle from the prism part 85 to the sensor 87 are set to each an angle of θ (=45 degrees). The residual amount of ink in the ink cartridge is detected based on the difference between the critical angle of total reflection determined by the flexion ratio between the ink in the cartridge 9 and the resin forming the case and the critical angle of total reflection determined by the flexion ratio between air and the resin forming the case.

Figure 19B:
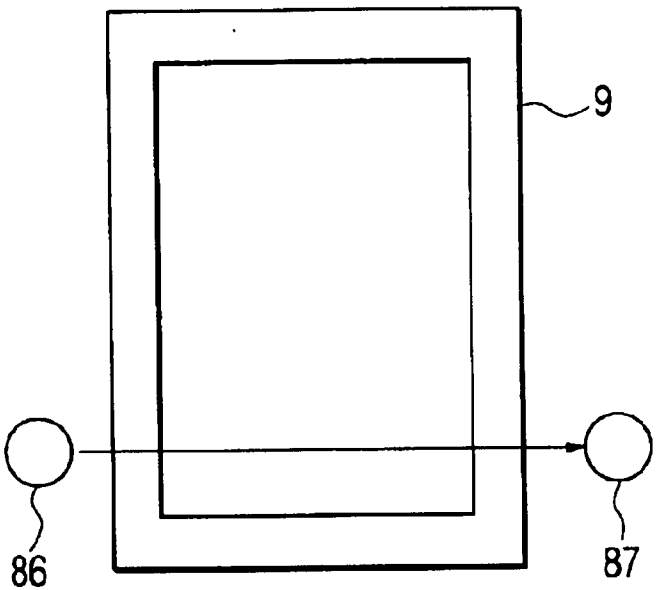
FIGS. 19A and 19B are schematic drawings to show a second example of the ink end detector.
Figure 19A:
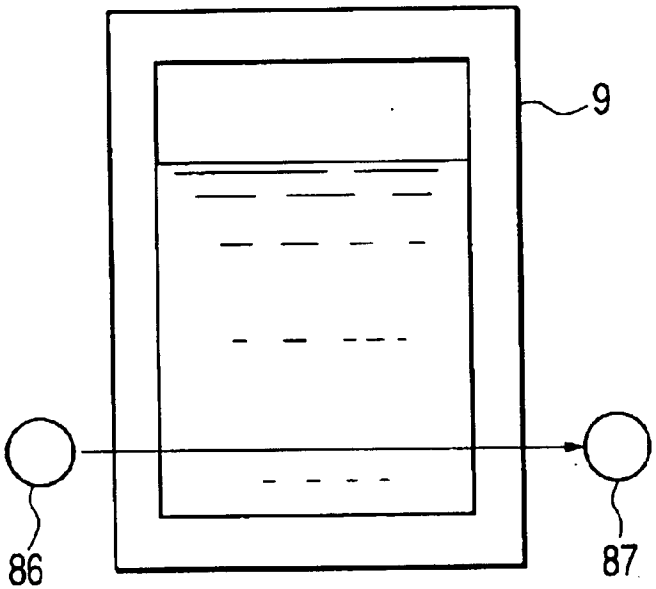

FIGS. 19A and 19B show a configuration wherein a case of an ink cartridge 9 is molded of a transparent resin and a light source 86 an a photosensor 87 are placed so as to sandwich the vicinity of the lower portion of the case. As shown in FIG. 19A, if a large amount of ink is stored in the ink cartridge 9, projection light from the light source 86 is blocked and thus the sensor 87 cannot sense the projection light. As shown in FIG. 19B, the ink in the cartridge 9 is decreased to less than a predetermined value, the sensor 87 can sense the projection light from the light source 86 through the case molded of a transparent resin and the residual ink amount is determined less than the predetermined value.

Figure 20:
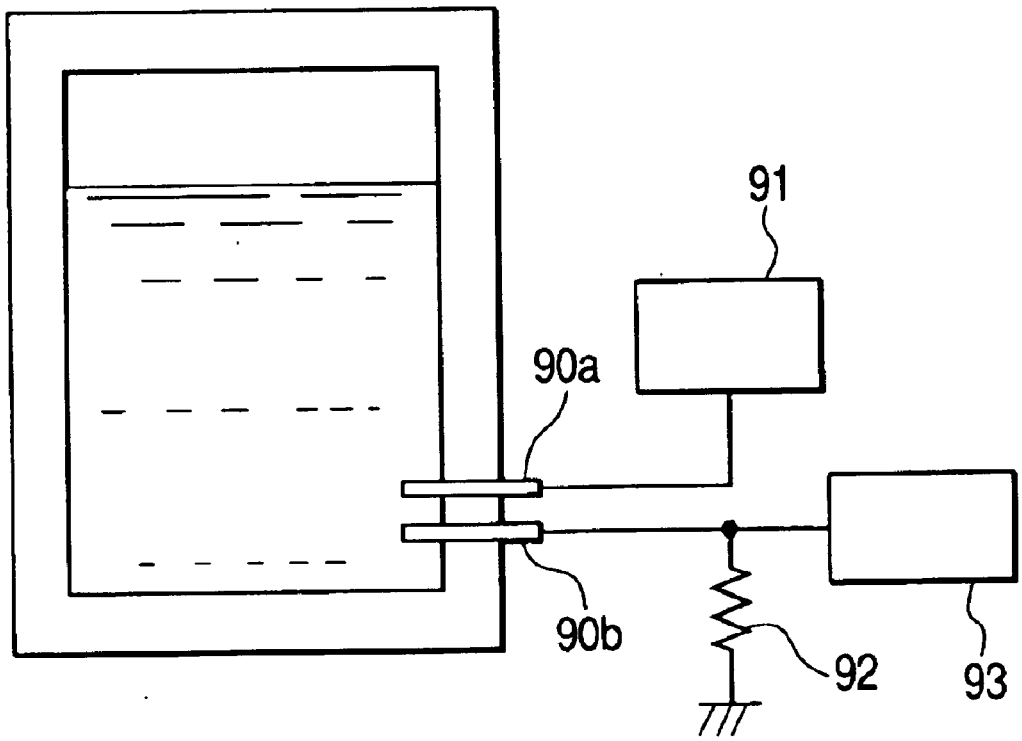
FIG. 20 is a schematic drawing to show a third example of the ink end detector.

Further, FIG. 20 shows a configuration wherein a pair of electrode terminals 90*a* and 90*b* is buried toward the storage space of ink in the proximity of the lower bottom face of a case of an ink cartridge 9 and a predetermined voltage is applied to one electrode terminal 90*a* from a constant-voltage source 91. A resistor 92 is connected to the other electrode terminal 90*b* between the electrode terminal and reference potential (ground) and a voltage detector 93 for detecting a potential occurring at the resistor 92 is connected to the other electrode terminal 90*b* mentioned above.

According to the configuration, if ink of a capacity to such an extent that the pair of electrode terminals is brought into conduction or more is left in the ink cartridge, the voltage detector 93 detects a predetermined voltage value or more. If the residual amount of ink in the ink cartridge is near an end condition, the voltage value detected by the voltage detector 93 lowers by far. Therefore, the configuration makes it possible to detect the residual amount of ink in the ink cartridge.

The ink end detector in the ink cartridge shown in FIGS. 18 to 20 described above can also be used replacing the numeric value of the residual amount counter of the cartridge at step S20 in FIG. 17 described above.

According to an ink jet recording apparatus adopting such a cartridge ink end determination method, if the amount of ink with which a subtank is replenished is insufficient although the ink replenishing time of the subtank from an ink cartridge exceeds a predetermined time period, the ink cartridge is determined to be in an ink end condition, so that the ink end condition of the ink cartridge can be recognized precisely. An ink end condition of an ink cartridge is detected by such a detection method, whereby uneconomical management of replacing the ink cartridge with a large amount of ink left or the like can be circumvented.

Next, there will be described a method of checking whether the overflow condition is erroneous detection of the ink level caused accidentally by a factor as mentioned above or an overflow condition caused by a true failure, in a case where the ink amount detector comprising the two hall devices 33*a* and 33*b* described above detects an overflow condition of ink. A control circuit is basically the same as that shown in FIG. 16 and therefore flowcharts are used for the description to follow.

Figure 21:
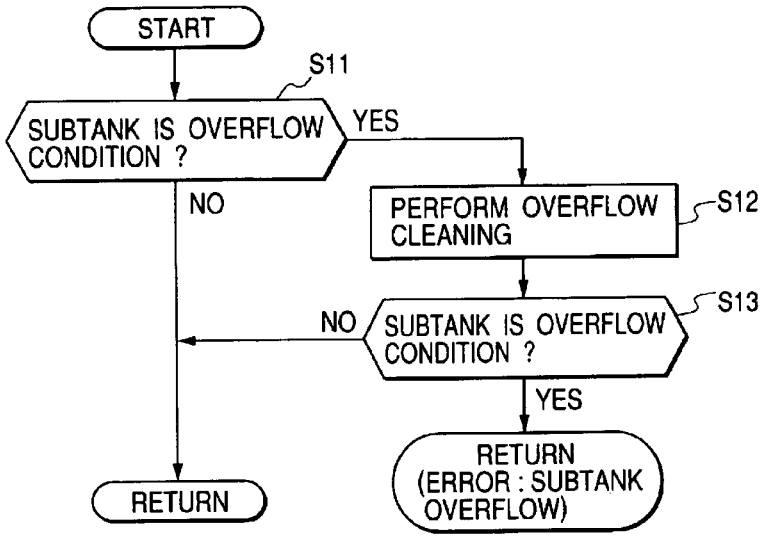
FIG. 21 is a flowchart to show the basic concept of a method of checking the replenished amount of ink to the subtank.

FIG. 21 is a flowchart to show the basic concept of a first checking method. That is, first as shown at step S11, whether or not subtank is in an overflow condition is checked based on the output combination of the two hall devices 33*a* and 33*b* making up the ink amount detector. If it is determined that the subtank is not in an overflow condition (No), control is returned and a similar determination is repeated from the start.

If it is determined at the step S11 that the subtank is in an overflow condition, overflow time cleaning operation is executed as shown at step S12. In the cleaning operation at this time (hereinafter, called as an overflow cleaning), the nozzle formation face of the recording head 6 is sealed with the capping unit 11 and negative pressure produced by the suction pump 15 is applied, whereby ink is sucked and discharged from the recording head. In the overflow cleaning, a larger amount of ink than that in the manual cleaning operation or timer cleaning operation is sucked and discharged.

At step S13 after execution of such overflow cleaning, again whether or not the subtank is in an overflow condition is checked by the ink amount detector. Here, if it is determined that the subtank is not in an overflow condition (No), the control is returned. Erroneous detection of the ink level accidentally caused by vibration, etc., is possible at the determination time at the step S11, in which case it is determined that the subtank is not in an overflow condition, of course. Although the subtank actually enters an overflow condition, the overflow condition may be canceled by executing the overflow cleaning at step S12. In any way, it is determined that the subtank is not in an overflow condition in the result of the rechecking, the printable state of the recording apparatus is continued.

On the other hand, if it is determined that the subtank is still in an overflow condition (Yes) in the result of the rechecking, it is estimated that the subtank enters an overflow condition because of some failure, in which case it is desirable that error display indicating the necessity for maintenance should be produced on the display 113.

Figure 22:
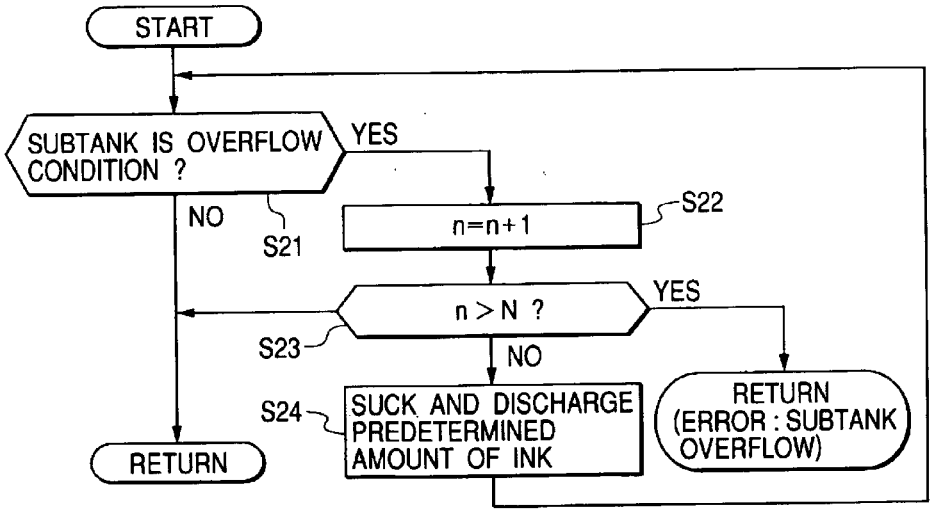
FIG. 22 is a flowchart to show the basic concept of a different checking method.

Next, FIG. 22 is a flowchart to show the basic concept of a second checking method when the ink amount detector detects an ink overflow condition. In the second checking method, the operation of sucking and discharging ink from the recording head is executed two or more times and whether or not the subtank is in an ink overflow condition is checked each time the operation of sucking and discharging ink is executed. That is, as shown at step S21, whether or not the subtank is in an overflow condition is checked based on the output combination of the two hall devices 33*a* and 33*b* making up the ink amount detector as at the step S11. If it is determined that the subtank is not in an overflow condition (No), control is returned and a similar determination is repeated from the start.

If it is determined at the step S21 that the subtank is in an overflow condition, the number of times the subtank has been determined to be in an overflow condition, n, is incremented by one as shown at step S22. The incremented number of times an overflow condition has been detected, n, is compared with a predetermined value N at step S23. Here, if it is determined that the number of times an overflow condition has been detected, n, is less than the predetermined value N (No), a predetermined amount of ink is sucked and discharged from the recording head. Also in this case, the nozzle formation face of the recording head 6 is sealed with the capping unit 11 and negative pressure produced by the suction pump 15 is applied, whereby ink is sucked and discharged from the recording head. The amount of sucking and discharging ink at the step S24 is controlled so as to become an amount less by far than that the amount of sucking and discharging ink in the overflow cleaning. Again, control returns to step S21 and whether or not the subtank is in an overflow condition is checked by the ink amount detector. If it is determined that the subtank is not in an overflow condition (No), control is returned. It can also be estimated that erroneous detection was accidentally caused by vibration, etc., at the previous ink level detection time, and the printable state of the recording apparatus is continued.

If it is determined that the subtank is in an overflow condition although again the check is made at step S21, the routine of incrementing the number of times the subtank has been determined to be in an overflow condition, n, by one as mentioned above is repeated. If it is determined at step S23 that the number of times the subtank has been determined to be in an overflow condition, n, reaches the predetermined value N (Yes), it is estimated that the subtank enters an overflow condition because of some failure. Also in this case, it is desirable that error display indicating the necessity for maintenance should be produced on the display 113.

According to the control routine shown in FIG. 22, the amount of ink discharged at a time from the recording head is lessened and whether or not the subtank is in an overflow condition is determined over several times. If it is determined that the overflow condition is canceled in a state in which the number of times the subtank has been determined to be in an overflow condition, n, does not reach the predetermined value N, the printable state of the recording apparatus is continued. Therefore, the control routine can contribute to a decrease in the total discharge amount of ink.

Figure 23:
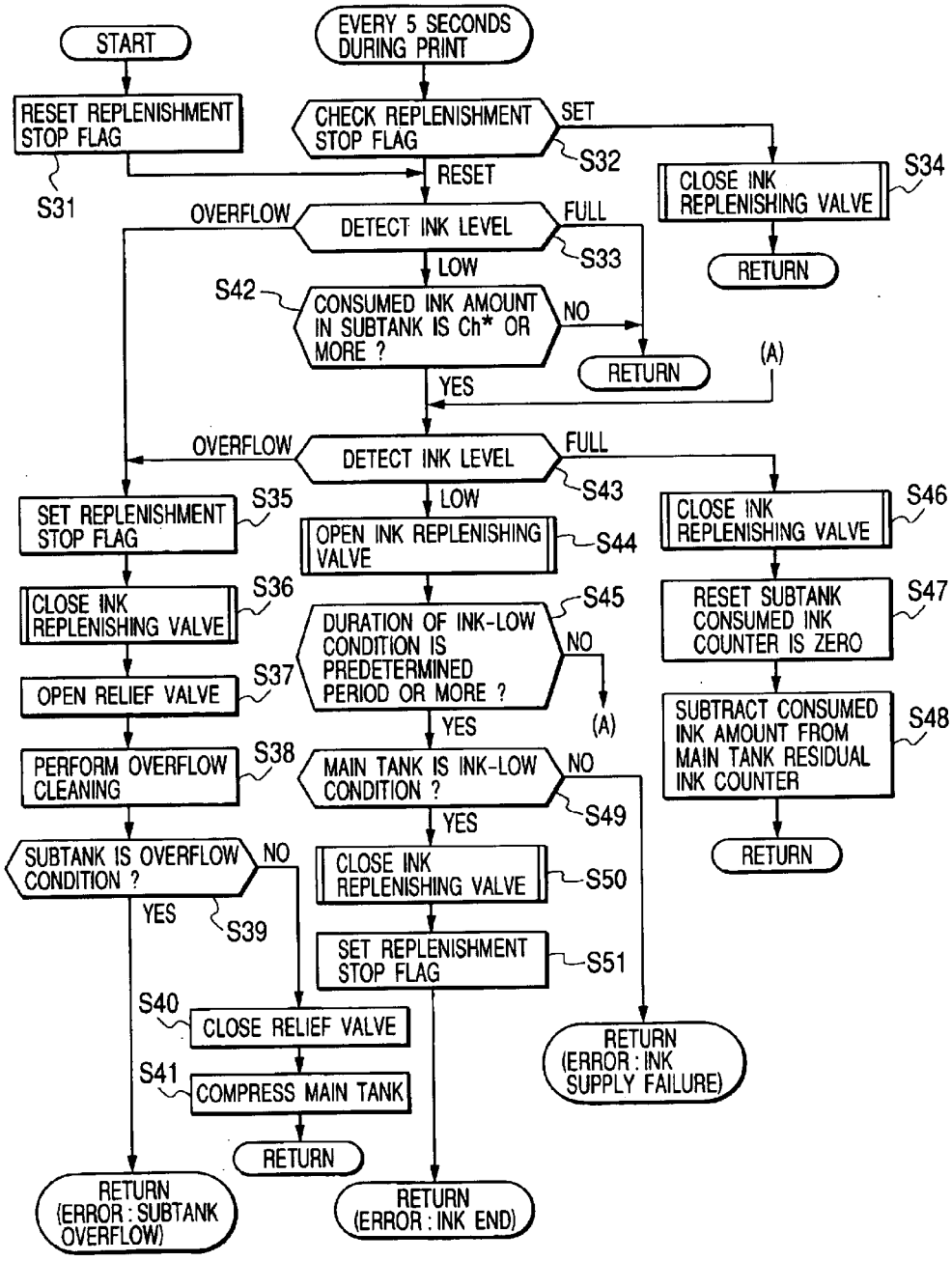
FIG. 23 is a flowchart to show a control routine to use the checking method shown in FIG. 21.

FIG. 23 shows a specific control routine to use the checking method shown in FIG. 21 for the ink replenishing system of the recording apparatus described above. The routine is executed separately for each of the main tanks as ink cartridges and each of the subtanks corresponding thereto. The control routine is started when the operation power of the recording apparatus is turned on and every five seconds, for example, during printing, and whether or not replenishing the subtank with ink from the main tank is enabled is determined.

First, when the operation power of the recording apparatus is turned on, a replenishing stop flag is reset as shown at step S31. That is, the replenishing stop flag is reset, whereby it is made possible to replenish the subtank 7 with ink. The amount of ink in the subtank 7 is determined from determination of ink level detection shown at step S33, namely, the output combination of the two hall devices 33*a* and 33*b* making up the ink amount detector.

On the other hand, during the print operation, the determination shown at step S32 is entered every five seconds as mentioned above, and whether the replenishing stop flag is set or reset is determined. If the replenishing stop flag is set, the subtank is not replenished with ink and the replenishing valve 26 is closed as shown at step S34, then control is returned. If it is determined at step S32 that the replenishing stop flag is reset, control goes to the step S33 and ink level detection in the subtank 7 is determined.

At step S33, which condition of ink overflow, full, and low is determined as mentioned above. If the condition is determined an overflow condition, control goes to step S35 and the replenishing stop flag is set. The replenishing valve 26 is closed as shown at step S36. Subsequently, the pressure regulating valve (relief valve) 22 is opened as shown at step S37, whereby compressed air by the air compressing pump 21 is released to the atmosphere. Here, the overflow cleaning is executed as shown at step S38. That is, the cleaning operation at this time is operation similar to that at step S12 previously described with reference to FIG. 21, whereby a large amount of ink is sucked from the recording head 6. At step S39 following the step, whether or not the amount of ink in the subtank 7 is an overflow condition is determined. That is, the step S39 is similar to step S13 previously described with reference to FIG. 21. If it is determined at the step S39 that the subtank is still in an overflow condition (Yes), it is estimated that the subtank 7 enters an overflow condition because of some failure, in which case error display indicating the necessity for maintenance is produced on the display 113.

On the other hand, if it is determined at the above-described step S39 that the subtank is not in an overflow condition (No), it can be estimated that the determination result of overflow at the step S33 is erroneous detection of the ink level caused accidentally. Therefore, in this case, the pressure regulating valve (relief valve) 22 is closed as shown at step S40 and the air compressing pump 21 is driven for pressuring the ink cartridge as shown at step S41. That is, the recording apparatus is restored to the printable state and control is returned.

If it is determined at the above-described step S39 that the subtank is not in an overflow condition (No), it can be estimated that in the previous ink level detection operation, vibration, etc., is received and erroneous detection results, as described above. Thus, in this case, a warning containing a message of "do not give vibration," or the like may be displayed on the display 113.

Control returns to the step S33 and if it is determined at the step S33 that ink is a full condition, the subtank 7 need not be replenished with ink, and control is returned. If it is determined at step S33 that ink is a low condition, control goes to step S42 and the count-up value of the subtank consumed ink counter 109 is referenced. Whether or not the consumed ink amount in the subtank is equal to or greater than "Ch*" is checked.

This "Ch*" is a predetermined value set as a parameter and if it is determined that the count-up value of the consumed ink counter 109 does not reach the predetermined value (No), control is returned. If it is determined that the count-up value of the consumed ink counter 109 reaches the predetermined value (Yes), control goes to the routine of replenishing the subtank 7 with ink.

In the embodiment, if the ink level detection result at step S33 is a low condition and the count-up value of the consumed ink counter 109 reaches the predetermined value or more, replenishing the subtank 7 with ink is started, as described above. Such a logical multiplication is applied, whereby the interval of replenishing the subtank 7 with ink can be prolonged, and the management accuracy of the storage amount of ink in the subtank 7 can also be enhanced.

That is, for example, if replenishing the subtank 7 with ink is started based only on the ink level detection result at step S33, replenishing with ink is started in the ink-low state condition and when the replenishing with ink is started, an ink full condition is detected and the replenishing with ink is stopped after the expiration of a short time. Further, the subtank enters an ink-low state condition after the expiration of a short time period and thus the ink replenishing operation is frequently repeated all the time. Therefore, replenishing with ink is not started until it is checked that the subtank enters an ink-low state condition and that the consumption amount of ink in the subtank 7 exceeds the predetermined value as described above, so that the ink replenishing operation is repeated at sufficient time intervals.

On the other hand, for example, if replenishing the subtank 7 with ink is started using only the count-up value of the consumed ink counter 109 shown at step S42, it is inevitable that a slight error will occur in the computation processing of the consumed ink amount calculator 107 shown in FIG. 16 and therefore the consumed ink counter 109 is reset and counted up repeatedly, whereby errors are accumulated and the amount of ink in the subtank 7 gradually grows and enters an overflow condition; in the worst case, the result of leaking ink from the subtank 7 is incurred. Alternatively, the level of ink in the subtank gradually decreases and the subtank becomes empty of ink and an accident in which air enters the ink flow passage leading to the recording head may be caused.

If the determination at step is "Yes," control goes to the routine of replenishing the subtank 7 with ink, as described above. At step S43 following step S42, ink level detection operation to monitor the ink level of the subtank based on replenishing with ink is performed. At this point in time, the ink level detection result is almost always low and at step S44, the replenishing valve 26 is opened and replenishing the subtank 7 with ink from the main tank 9 is started.

At step S45, whether or not a time period in which the ink low condition has been continued reaches a predetermined value is checked. In other words, here the elapsed time period after the replenishing valve 26 was opened at step S44 is measured by the timer 112 shown in FIG. 16. At this point in time, the ink level low duration does not reach the predetermined time period and the determination is "No". Therefore, control again returns to step S43 via a loop of (A) shown in FIG. 23 and the state of replenishing the subtank 7 with ink is monitored. That is, the ink replenishing routine from step S43 to S45 is repeated. If it is determined at step S43 that the ink level of the subtank becomes a full condition, control goes to step S46.

At step S46, the replenishing valve 26 is closed. The consumed ink counter 109 of the subtank 7 is reset to zero as shown at step S47. At step S48, the count of the consumed ink counter (most recent) is subtracted from the count of the cartridge residual amount counter and control is returned. As this subtraction operation, as described above, the count of the consumed ink counter 109 of the subtank just before reset (most recent) is sent to the residual amount counter 110 of the main tank 9 and is subtracted from the count indicating the residual amount of ink in the main tank. Accordingly, the residual amount of ink in the main tank 9 can be managed.

On the other hand, if an overflow condition is detected in a state in which replenishing the subtank 7 with ink is monitored via the loop (A) as described above, the routine of step S35 and later previously described is entered and the overflow condition is again checked.

If it is determined at the step S45 that the time period in which the ink low condition has been continued exceeds the predetermined time period (Yes), it means that the subtank 7 is not sufficiently replenished with ink although the ink replenishing time of the subtank 7 reaches a predetermined time period. Therefore, control goes to step S49 and the residual amount of ink in the ink cartridge is referenced. In this case, the value of the residual amount counter 110 of the main tank 9 is referenced and if the determination is ink-low state (Yes), ink in the ink cartridge is insufficient and the replenishing valve 26 is closed as shown at step S50. The replenishing stop flag is set as shown at step S51. In this case, it is desirable that error display indicating that the ink cartridge is in an ink out (ink end) condition should be produced on the display 113.

If it is determined at the step S49 that the value of the residual amount counter 110 of the main tank 9 is not ink-low state (No), it can be assumed that the ink supply system undergoes some failure and the subtank is not replenished with ink. In this case, it is desirable that error display indicating an ink supply failure should be produced on the display 113.

Figure 24:
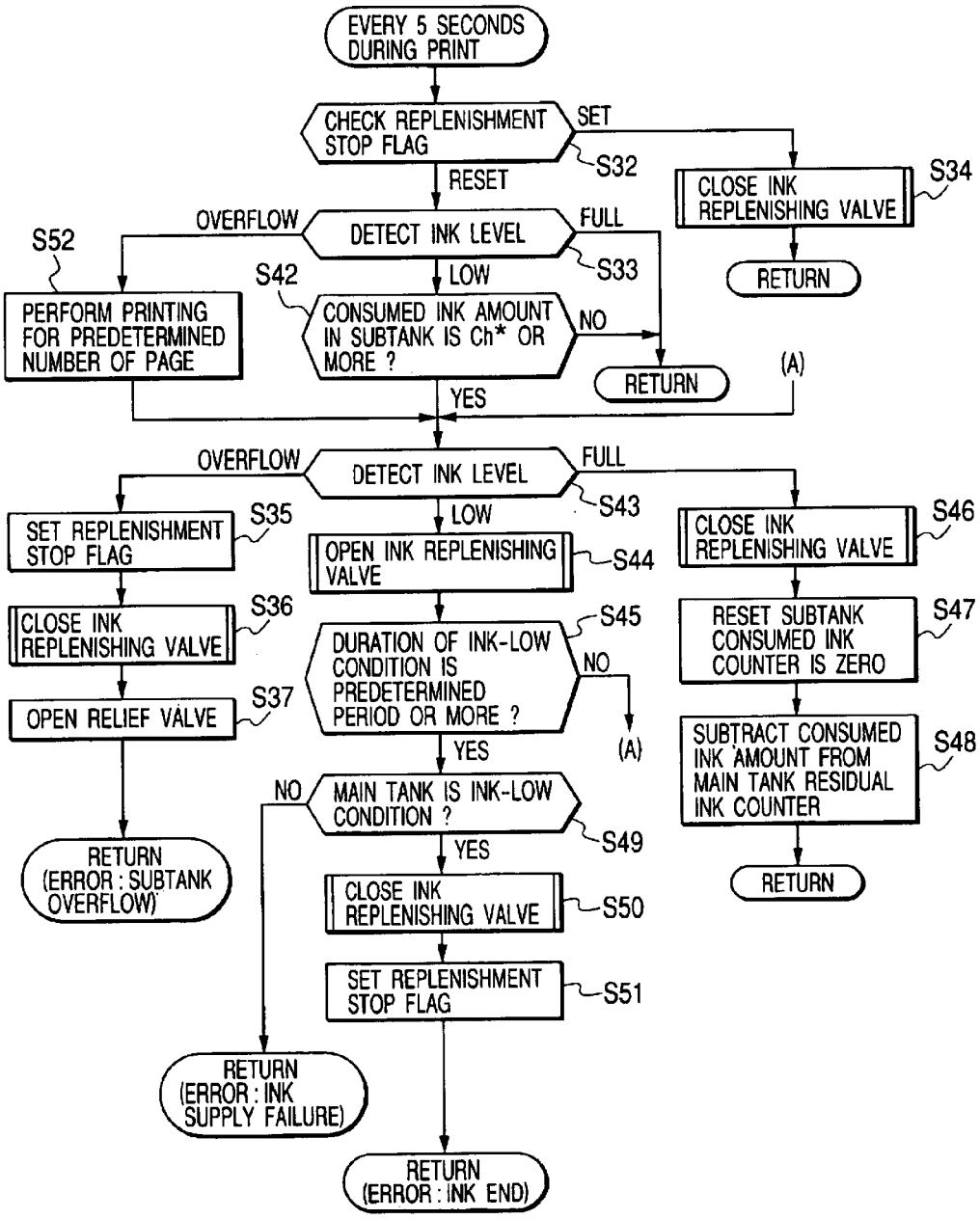
FIG. 24 is a flowchart to show a control routine to use different checking method for the ink replenishing system.

FIG. 24 shows a control routine for again checking whether or not the subtank is in an overflow condition after ink is consumed through the recording head when the ink amount detector of the subtank detects an overflow condition of a larger amount of ink than the predetermined value. The routine is executed separately for each of the main tanks as ink cartridges and each of the subtanks corresponding thereto. The control routine is started every five seconds, for example, during printing of the recording apparatus, and whether or not replenishing the subtank with ink from the main tank is enabled is determined.

The control routine shown in FIG. 24 has a control mode roughly similar to that of the control routine previously described with reference to FIG. 23. Therefore, the corresponding steps are denoted by the same step numbers and will not be discussed again in detail. In the control routine shown in FIG. 24, if the condition is determined an overflow at the determination of ink level in the subtank at step S33, control goes to step S52. As shown at step S52, print is executed to the end of a predetermined number of page, thereby consuming ink through the recording head.

In this case, it is practical to control so as to continue the print execution of the predetermined amount to the end of the corresponding one page; for example, however, print execution may be continued to the end of all pages corresponding to the print command received from the host computer. Control goes to step S43 in the state in which ink is consumed by executing the step S52, and again the ink level condition in the subtank is checked. If the condition is still determined an overflow as a result of the rechecking, the routine at step S35 and later is entered.

In the control routine shown in FIG. 24, the rechecking at steps S38 to S41 shown in FIG. 23 is not executed. The reason why the rechecking is not executed is that whether or not the condition is still an overflow is already rechecked at step S43 after ink is consumed at step S53.

As seen from the description made above, according to the ink jet recording apparatus adopting the check method of the ink replenished amount of the subtank, the ink amount detector of the subtank detects an overflow condition of a larger amount of ink than the predetermined value, whether or not the condition is an ink overflow condition is rechecked after execution of the recovery measure. If the overflow condition is released as a result of the rechecking, the printable state is continued, so that stopping the operation of the recording apparatus caused by an erroneous determination made accidentally can be avoided.

In each of the embodiments previously described with reference to FIGS. 2 to 24, air pressure produced by the air compressing pump is applied to each subtank and the corresponding ink replenishing valve is opened or closed in response to the detection condition of the amount of ink stored in each subtank; each embodiment is shown as one preferred embodiment in the ink supply system of the recording apparatus.

Figure 25:
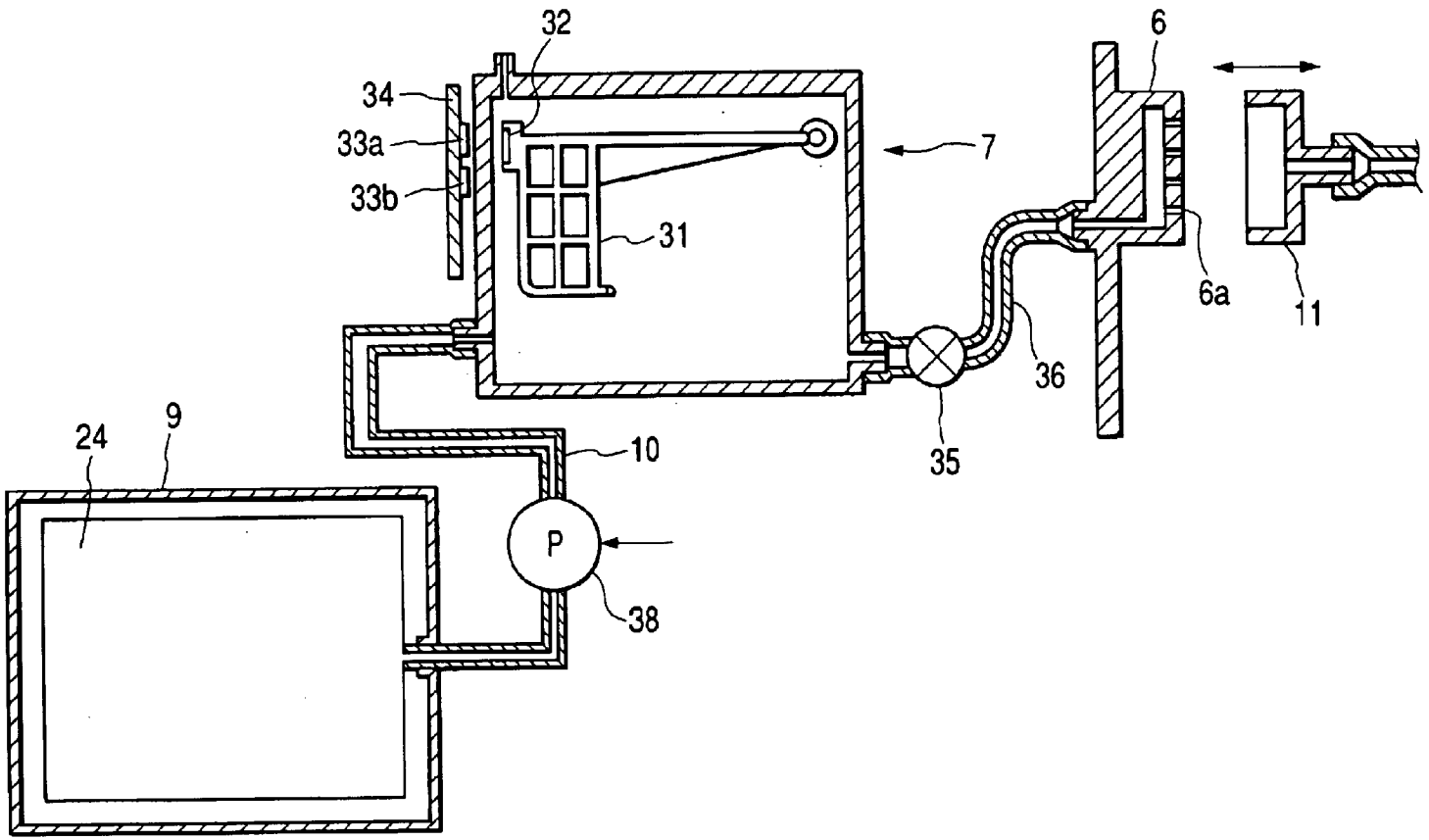
FIG. 25 is a schematic drawing to show another configuration of the ink supply system.

However, the invention is not limited to the embodiments; for example, a mode as shown in FIG. 25 can also be adopted preferably. That is, in the mode shown in FIG. 25, an ink supply system is shown schematically and can be described in comparison with the ink supply system previously described with reference to FIG. 2. Parts corresponding to those previously described with reference to FIG. 2 are denoted by the same reference numerals in FIG. 25 and therefore will not be discussed again in detail.

In the ink supply system shown in FIG. 25, an ink pack 24 formed of a flexible material in which ink is sealed is stored in a main tank 9 and the ink sealed in the ink pack 24 is sent out by driving an ink supplying pump 38 as an ink replenishing controller so that a subtank 7 is replenished with the ink via a flexible tube 10 as an ink replenishing passage.

The ink supplying pump 38 is driven appropriately in response to the detection state of ink amount detector made up of a combination of a permanent magnet 32 on a float member 31 placed in the subtank 7 and hall devices 33*a* and 33*b*.

According to the configuration, if it is recognized that the amount of ink in the subtank 7 lowers based on the electric output provided by the hall devices 33*a* and 33*b*, the ink supplying pump 38 corresponding to the subtank is driven, whereby the subtank is replenished with ink separately from the main tank. If the amount of ink in the subtank 7 reaches a predetermined volume, driving the ink supplying pump 38 is stopped based on the electric output of the hall devices

33*a* and 33*b* mentioned above. Such a sequence is repeated, whereby the subtank is replenished intermittently with ink from the main tank and an almost constant amount of ink is always stored in each subtank.

According to the configuration, the configuration of applying the air pressure produced by the air compressing pump forming a part of the compressor unit to each main tank as in the embodiments shown in FIGS. 2 to 24 becomes unnecessary, so that the configuration of the ink supply system can be simplified to some extent.

In the ink supply system shown in FIG. 25, if the operation power of the recording apparatus is turned off, driving the ink supplying pump 38 is also stopped, of course, and ink flow is blocked. Accordingly, a problem of backward flowing of ink from each subtank 7 to each main tank 9 can be circumvented. In the ink supply system shown in FIG. 25, the consumed ink amount calculator in each subtank, which is provided as a software, can also be used together.

Next, a third embodiment will be discussed with reference to FIGS. 26 and 27. Parts identical with or corresponding to those previously described with reference to FIGS. 2 to 25 are denoted by the same reference numerals in FIGS. 26 and 27 and will not be discussed again. In the embodiment, a subtank unit is replenished with an amount of ink matching the amount of ink consumed in a recording head by pump controller, so that the ink level in the subtank unit can be maintained with high accuracy in an optimum state for print without incurring complicity of a structure of ink level detector, etc.

Figure 26:
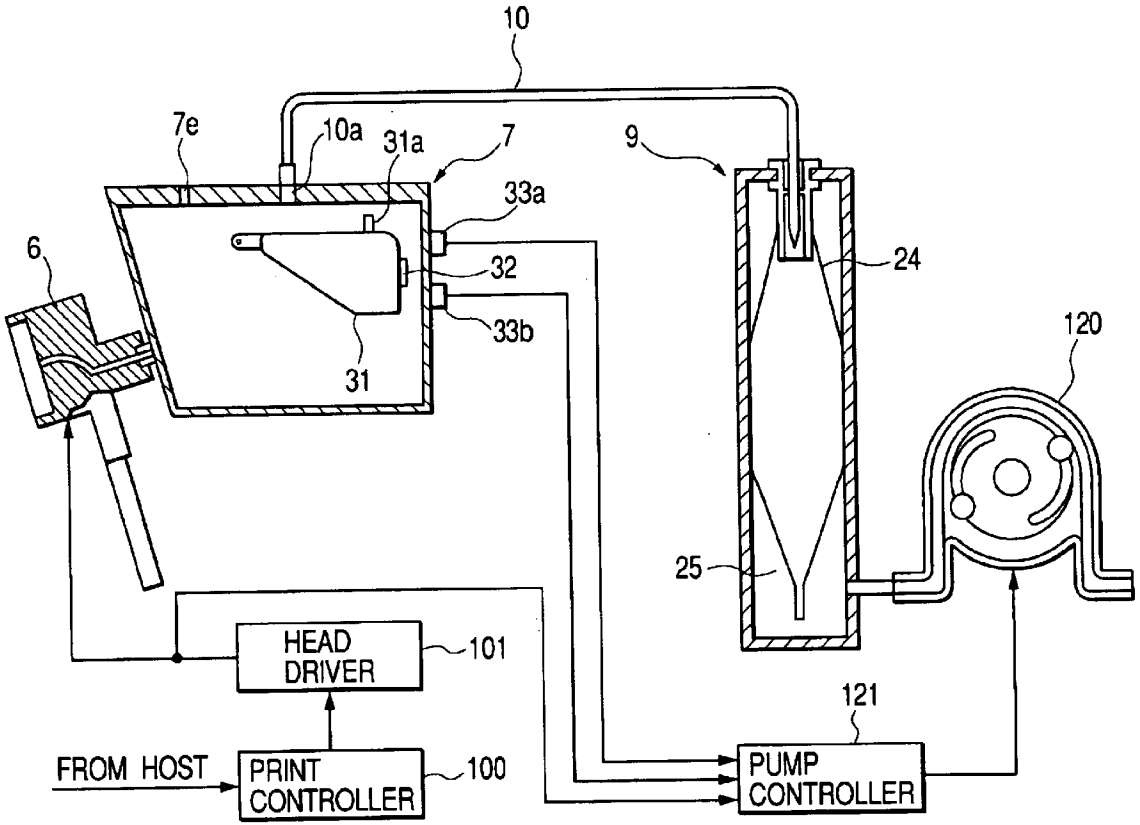
FIG. 26 is a block diagram to show an ink supply system from the main tank to the recording head, according to a third embodiment of the invention.

FIG. 26 is a block diagram to show the third embodiment. A subtank unit 7 is implemented as a vessel comprising an atmospheric release port 7*e* and an ink supply port 10*a* in the top and a float member 31 for detecting an ink level is placed in the vessel. A magnetic substance 32 is placed on the float member 31 and magnetoelectric devices 33*a* and 33*b* each as a sensor for detecting the magnetic substance 32 are placed at positions facing the upper and lower limits of the ink level.

An ink cartridge 9 in the embodiment comprises an ink pack 24 stored in a hard case that can be sealed and an air pump 120 is connected to the space between the hard case and the ink pack 24 so that the ink pack 24 is compressed by air for discharging ink.

Pump controller 121 controls a flow amount so that the ink level in the subtank unit becomes at least above the lower limit value and below the upper limit value based on signals from the magnetoelectric devices 33*a* and 33*b* as sensors, and drives an air pump 120 in response to ejection by head driver 101.

In the embodiment, when the subtank unit 7 is not replenished with ink, the pump controller 121 drives the air pump 120 based on the signals from the magnetoelectric devices 33*a* and 33*b* as replenishing sensors for the subtank 7 with ink in an ink cartridge 9 to a stipulated level.

When a print signal is input from a host not shown, print controller 100 controls the head driver 101 to execute print through a recording head 6. The pump controller 121 adjusts the displacement of the air pump 120 while detecting the amount of ink consumed through the recording head 6 based on a signal from the head driver 21, and discharges ink so that the ink outflow amount from the ink cartridge 9 matches the consumed ink amount in the print.

Accordingly, at the text print time less consuming ink, ink in the ink cartridge 9 flows into the subtank 7 in a small flow amount and in graphics print, etc., much consuming ink, ink in the ink cartridge 9 flows into the subtank 7 in a large flow amount, so that the ink level in the subtank is always maintained in an optimum state.

Since the subtank unit 7 is thus replenished with an amount of ink matching the consumed ink amount in the recording head 6 from the ink cartridge, the ink level in the subtank unit can always be maintained in an optimum state without receiving the effect of hysteresis or a dead band of the ink level detector of the float, etc.

Figure 27:
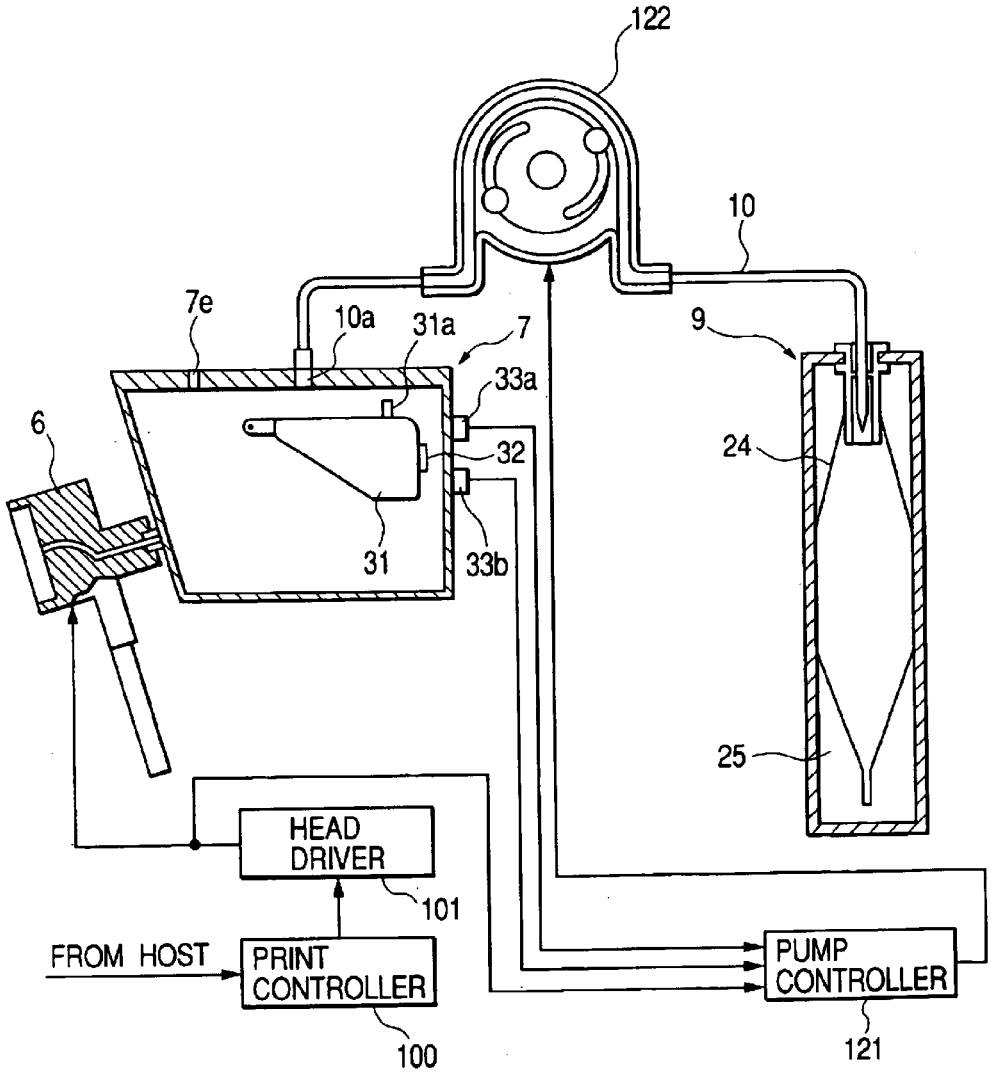
FIG. 27 is a block diagram to show a modified example of the embodiment in FIG. 26.

In the above-described embodiment, the ink pack 24 is compressed by air for replenishing the subtank 7 with ink, but if an ink supplying pump 122 is connected to a midpoint of an ink supply tube 10 as shown in FIG. 27 and the flow amount of the pump 122 is controlled, a similar advantage can also be provided.

An ink replenishing method capable of properly maintaining the ink level in the subtank 7 using the magnetoelectric devices 33*a* and 33*b* as sensors and judgement circuit in the third embodiment described above will be discussed with reference to FIG. 28.

Figure 28:
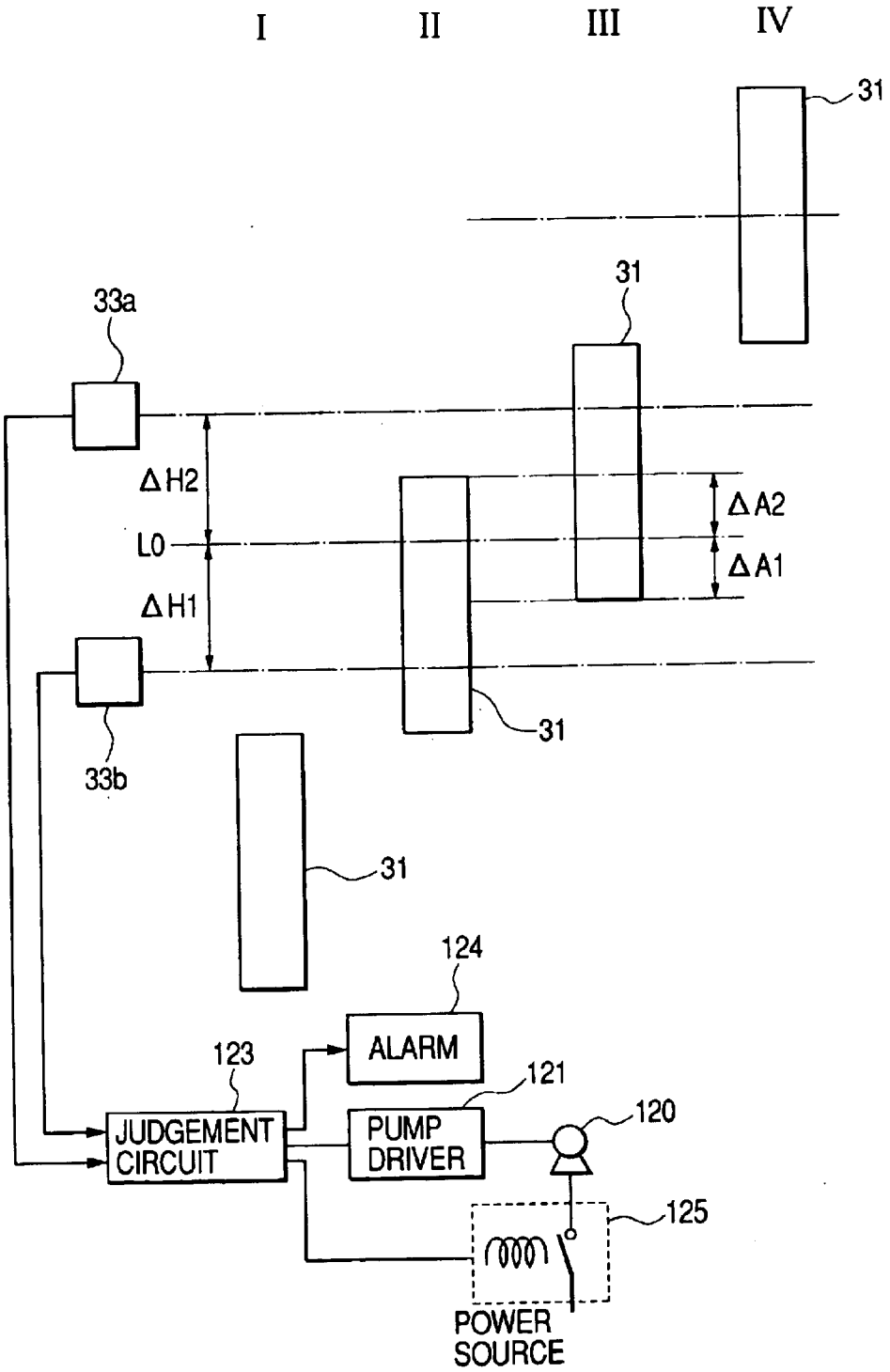
FIG. 28 is a block diagram to show ink amount detector used with the embodiment shown in FIGS. 26 and 27.

As shown in FIG. 28, the magnetoelectric devices 33*a* and 33*b* as sensors are placed with a spacing of $\Delta H1+\Delta H2$ so that ink in the subtank 7 can be detected above and below stipulated level L0 and a magnetic field of the permanent magnet 32 as an indicator can be detected in a predetermined range, namely, a range $A(=\Delta A1+\Delta A2)$ in which the ink level should be maintained at the same time.

Accordingly, if the float member 31 moves down more than $\Delta A1$ below the position corresponding to the stipulated level L0, the magnetic field of the indicator 32 does not act on the upper magnetic sensor 33*a* and the fact that the ink level decreases to the liquid amount requiring pouring can be detected, and if the float member 31 moves up more than $\Delta A2$ above the position corresponding to the stipulated level L0, the magnetic field of the indicator 32 does not act on the lower magnetic sensor 33*b* and the fact that the ink level reaches the liquid amount to stop pouring can be detected.

That is, in the range of $\Delta A1+\Delta A2$ in which the ink level should be maintained properly, the magnetic flux distribution of the indicator 32, the sensitivities of the magnetic sensors 33*a* and 33*b*, and the placement spacing $\Delta H1+\Delta H2$ therebetween are adjusted so that the magnetic field of the indicator 32 acts on the two magnetic sensors 33*a* and 33*b* at the same time.

The range of $\Delta A1+\Delta A2$ in which the ink level should be maintained becomes narrow if the spacing between the magnetic sensors 33*a* and 33*b* is widened, and the range becomes wide if the spacing is lessened. If an indicator having a large magnetic flux distribution in an up and down direction is used as the indicator 32, the range in which the ink level should be maintained can be enlarged.

The float member is formed on the top with a projection 31*a* (see FIGS. 26 and 27) for defining the upper limit position of the float member 31 regardless of a rise in the ink level, and the projection 31*a* abuts the upper face of the subtank 7 for limiting the rise position of the float member 31 and preventing the float member 31 from moving outside the detection range of the magnetic sensor 33*a*.

In the embodiment, the float member is formed with the projection 31 a for regulating the upper limit, but if the subtank is formed with a projection, a similar advantage can also be provided.

A judgement circuit 123 for receiving signals from the magnetic sensors 33*a* and 33*b* assumes that ink is of a too small amount, and outputs a first error signal if the first and second magnetic sensors 33*a* and 33*b* output both low signals (in the embodiment, the low signal means a state in which a magnetic flux is not detected and a high signal means a state in which a magnetic flux is detected).

If a high signal is output only from the first magnetic sensor 33*b* at the lower position, a pouring start signal is output.

Further, high signals are output from both the first and second magnetic sensors 33*a* and 33*b*, the liquid amount is maintained properly and therefore a pouring stop signal is output.

Further, if a high signal is output only from the second magnetic sensor 33*a* at the upper position, it is assumed that ink is oversupplied, and a second error signal is output.

The first error signal from the judgement circuit 123 is output to an alarm 124, the pouring start signal and the pouring stop signal are output to pump driver 121, and the second error signal is output to a forcible stopper 125, in the embodiment, a switch for outputting drive power to the pump 120 (122).

Such control is performed, whereby the ink level in ink supply unit 3 is maintained in the range of −ΔA1 to +ΔA2 sandwiching the stipulated level L0 therebetween and ink can be supplied to the recording head 4 at the water head difference appropriate for print.

By the way, if the pump 120 (122) continues to operate because of trouble of the pump driver 105 although the judgement circuit 123 outputs a pouring stop signal at replenishing with ink, the float member 31 moves up to a top dead center defined by the projection 31*a*. In this state, a low signal is output from the first magnetic sensor 33*b* and a high signal is output from the second magnetic sensor 33*a* and thus the judgement circuit 123 outputs a second error signal to the forcible stopper 125 for shutting down the operation power supplied to the pump 120 (122) and forcibly stopping pouring of ink, thereby preventing an overflow.

If a larger amount of ink than the stipulated amount is thus poured, the float member 31 is stayed at the given upper limit position by the projection 31*a*, so that the magnetic field of the indicator 32 acts on the second magnetic sensor 33*a* and the state can be distinguished from the state in which ink becomes too small. That is, if the upper limit position of the float member 31 is not regulated, the indicator 32 moves to a position at which the magnetic field of the indicator 32 does not act on the second magnetic sensor 33*a*, and the state cannot be distinguished from the state in which ink becomes too small.

As described above, the indicator of a magnetic substance is placed in the subtank, the float member whose upper limit position is regulated is housed, at least two magnetic sensors are placed so as to sandwich the stipulated ink level therebetween in the up and down direction in areas being outside the ink supplier, where the magnetic flux of the indicator can be received at the same time, and at least three types of ink levels are detected based on the signals of the magnetic sensors, so that not only the predetermined width, but also the limit amount of the amount of ink in the ink supply unit is detected by a number of sensors as small as possible, and the subtank can be replenished with ink with high accuracy.

In the ink jet recording apparatus, if the time elapses with the subtank filled with ink, the dissolved air amount of ink in the subtank increases and the ink becomes saturated. If print is started in a state in which ink in the subtank is thus saturated, a sufficient negative pressure is not applied in the recording head and the eject state becomes unstable and at the cleaning time, bubbles occur and the cleaning easily becomes insufficient; this is a problem.

Next, an embodiment for solving such a problem will be discussed. An ink jet recording apparatus comprises: a print controller 100 for creating bit map data based on a print signal from a host; a carriage controller 130 for controlling a motor 131 for controlling a movement of a carriage 1 in a main scanning direction; and a head driver 101 for driving piezoelectric vibrators based on a signal from the print controller 100 for ejecting ink drops through a recording head 6.

The recording apparatus also comprises a timer 133 being started when the power of the recording apparatus is turned off, etc., for measuring the non-operating period of the recording apparatus until the power is then turned on, and a refilling (re-replenishing) controller 132 for discharging ink in a subtank 7 and filling again the subtank with fresh ink in a main tank 9 if the non-operating time measured by the timer 133 reaches at a predetermined time period or more.

A discharging passage 134 provided with a discharging valve 135 opened and closed as instructed by the refilling controller 132 communicates with the subtank 7. On the other hand, the main tank 9 is provided with a pack compressor 136 consisting of an air compressing pump 21, a pressure regulating valve 22, and a pressure detector 23 for pressurizing the inside of the main tank 9 to compress an ink pack 24 for filling (replenishing) the subtank 7 with ink in the ink pack 244 as instructed by the refilling controller 132.

Here, the dissolved air amount of ink in the subtank 7 increases and soon the ink becomes saturated as the non-operating time of the recording apparatus since the recording apparatus was turned off is prolonged. If print is executed in such ink with the dissolved ink saturated, cleaning and ejecting become easily unstable as described above.

Therefore, the predetermined time period for determining whether or not the subtank is to be re-filled (re-replenished) with ink is set to the time at which the saturation degree of ink in the subtank 7 arrives at a given value or more and when the recording apparatus in a non-operating state is turned on, if the non-operating time exceeds the time, the saturation degree of ink in the subtank 7 is high and thus the ink in the subtank is discharged and is replaced with fresh ink before print is executed. On the other hand, if the non-operating time does not reach the time, since the ink ejection is stable to some extent, print is executed without performing the cleaning or the refilling (re-replenishing).

The recording apparatus having the configuration described above can be used, for example, as follows: First, when the power of the recording apparatus in a non-operating state is turned on, the timer 133 measures the non-operating time until the power is now turned on since the power was previously turned off. Next, if the non-operating time measured by the timer 133 reaches a predetermined time period, as instructed by the refilling controller 132, the discharging valve 135 is opened for discharging ink remaining in the subtank 7, and then the pack compressor 136 pressurizes the inside of the main tank 9 to compress the ink pack 24 for filling the subtank 7 with ink in the ink pack 24. The subtank 7 is filled with fresh ink before print is executed. On the other hand, if the non-operating time period measured by the timer 133 does not exceed the predetermined time period, print is started.

Thus, if the ink in the subtank 7 becomes saturated while the recording apparatus is non-operating, when operation of the recording apparatus is restarted, the saturated ink is discharged and is replaced with fresh ink, so that instabilization of cleaning and ejecting caused by ink degradation in the subtank 7 is prevented. Ink not so much degraded in a short non-operating time need not be discharged, so that fruitless consumption of ink can be decreased.

In the above-described embodiment, the subtank 7 may be filled with ink before the recording apparatus enters a non-operating state. In doing so, the time until the dissolved air of ink in the subtank 7 reaches saturation can be prolonged to the maximum, so that the predetermined time period can be set long accordingly and while the non-operating time is not so much long, operation of the recording apparatus can be restarted without replacing ink in the subtank 7 and fruitless consumption of ink can be decreased.

Figure 29:
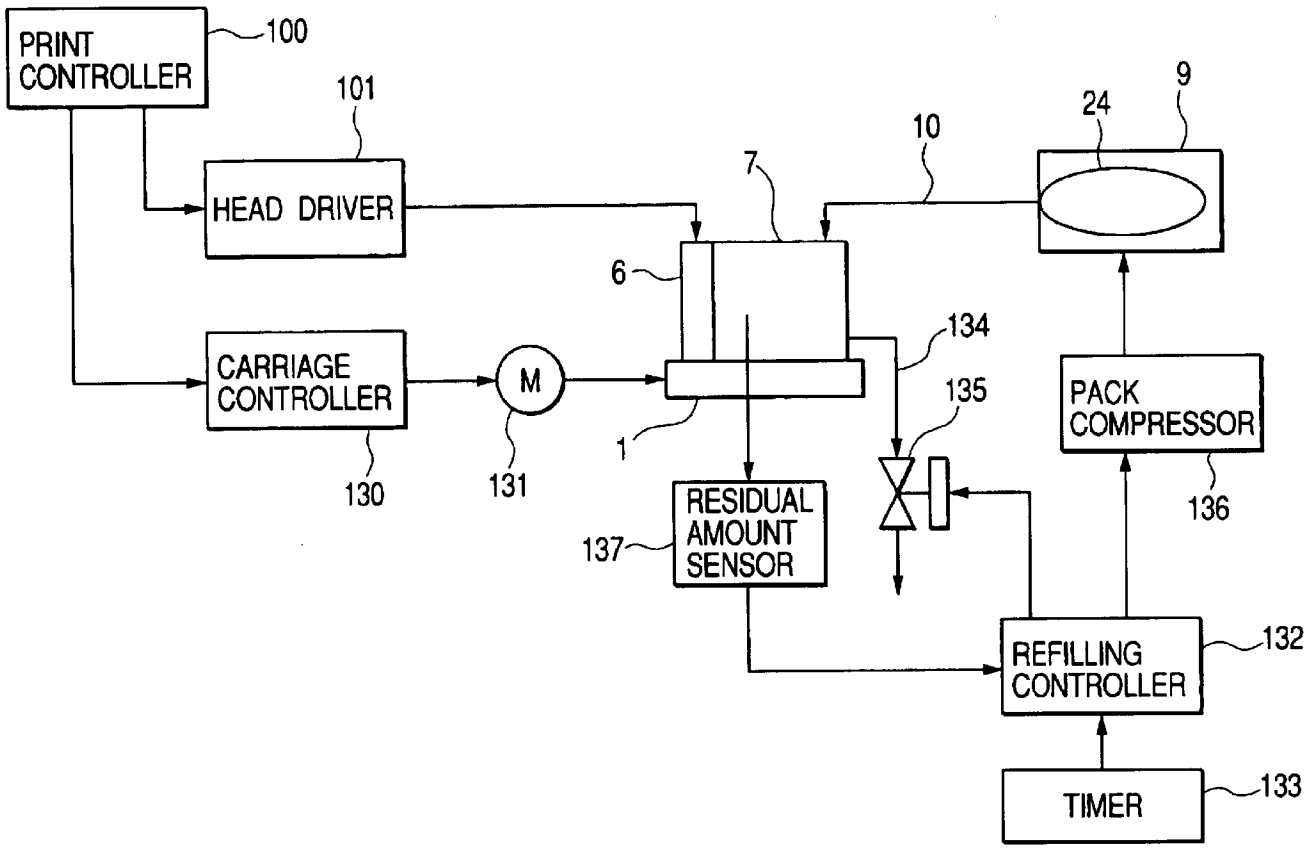
FIG. 29 is a schematic drawing to show an ink supply system from the main tank to the recording head, according to a fourth embodiment of the invention.
Figure 30:
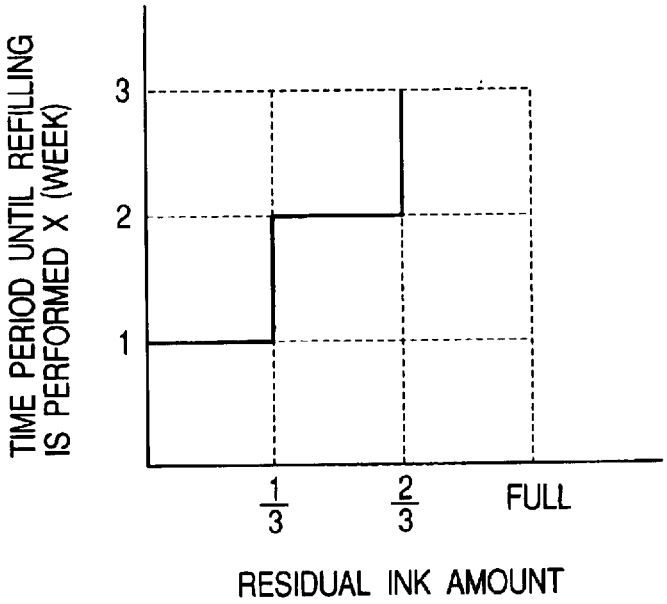
FIG. 30 is a chart to show the relationship between the time to re-fill (re-replenish) and the residual ink amount.

More preferably, a residual amount sensor 137 consisting of a permanent magnet 32 and a hall device 33 for sensing the residual amount of ink in a subtank 7 is provided as shown in FIG. 29, and a timer 133 is set so that a time period X until the refilling is performed becomes shorter as the residual amount of ink in the subtank 7 is less, as shown in FIG. 30. In the example, when the residual amount of ink is to one third, the time period X is set to one week, when the residual amount of ink is in the range of a third to two thirds, the time period X is set to two week, and when the residual amount of ink is in the range of two thirds to a fill-up, the time period X is set to three weeks.

Figure 31:
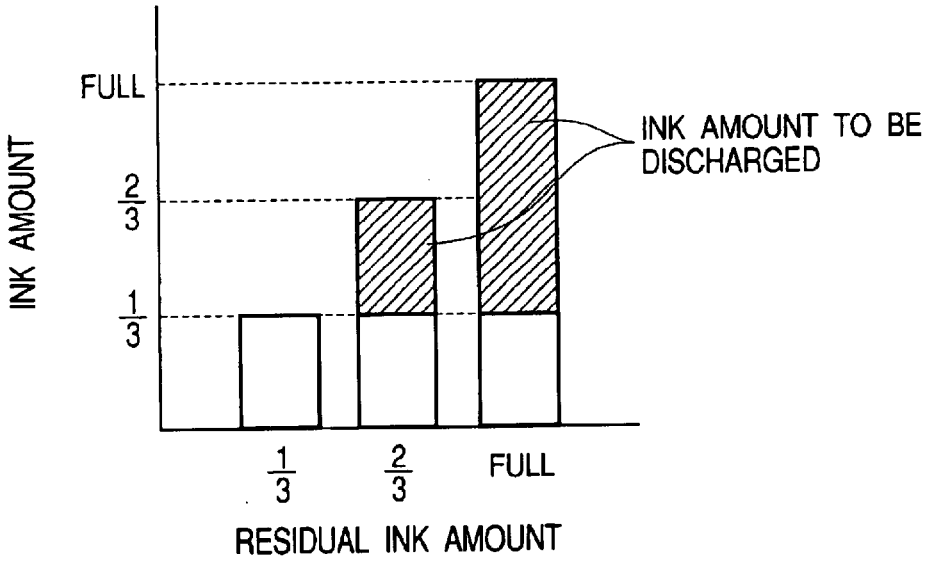
FIG. 31 is a chart to show the relationship between the residual ink amount and the discharged ink amount.

In the recording apparatus, saturated ink is discharged reliably and ink not so much degraded need not be discharged, so that the ink use efficiency can be enhanced. When the recording apparatus shown in FIG. 29 is used and operation of the recording apparatus in a non-operating state is restarted, ink in the subtank 7 may be discharged with some of the ink left and the subtank 7 may be filled with fresh ink, as shown in FIG. 31. In the example, ink in the subtank 7 is discharged to one third the capacity of the subtank 7 and the subtank is filled with fresh ink with the ink left in the subtank in one third the capacity.

In the recording apparatus, if saturated ink remains in the subtank 7 to some extent, the ink is mixed with fresh ink, whereby the saturation degree can be lowered until given stability can be provided as a whole, so that ink consumption can be decreased accordingly.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An ink jet recording apparatus comprising:

a recording head, mounted on a carriage which reciprocally moves in a widthwise direction of recording paper;

a non-flexible subtank formed with an airhole, mounted on the carriage for containing ink therein;

a main tank, storing ink which is replenished to the subtank;

an ink amount detector, which detects an amount of ink stored in the subtank;

a replenishment controller, which controls replenishment of ink stored in the main tank to the subtank, in accordance with the ink amount detected by the ink amount detector; and a compressor, which maintains the main tank in a compressed state, wherein the replenishment controller includes an ink replenishing valve which is opened or closed by a control signal generated by the ink amount detector for replenishing ink stored therein to the subtank, and wherein the ink amount detector includes a float member floating on the ink stored in the subtank, and an output generator which generates an electrical output in accordance with a floating position of the float member, which changes according to the stored ink amount.

2. The recording apparatus as set forth in claim 1, wherein the replenishment controller blocks ink communication when an operation power of the apparatus is turned off.

3. The ink jet recording apparatus as set forth in claim 1, wherein the ink replenishing valve includes a diaphragm valve, a slide shaft provided in a substantially center portion of the diaphragm valve, and an actuator which moves the slide shaft in an axial direction thereof to open or close the diaphragm valve.

4. The recording apparatus as set forth in claim 3, wherein the replenishing valve includes a case which accommodates the diaphragm valve therein, so that an aperture formed on the case is opened or closed by the diaphragm valve.

5. The recording apparatus as set forth in claim 3, wherein the center portion of the diaphragm valve is horizontally movable.

6. The recording apparatus as set forth in claim 5, wherein a tube for replenishing ink to the subtank is vertically connected to the case; and wherein a first ink supply passage connecting the main tank and the diaphragm valve and a second ink supply passage connecting the diaphragm valve and the ink replenishing tube are arranged so as to extend perpendicularly to each other.

7. The recording apparatus as set forth in claim 3, wherein the actuator is an electromagnetic plunger.

8. The recording apparatus as set forth in claim 7, wherein the ink replenishing valve includes a pivotal lever member, and wherein a driving force of the electromagnetic plunger is acted on one end of the lever member so that the driving force is transmitted to the slide shaft via the other end of the lever member.

9. The recording apparatus as set forth in claim 7, wherein the diaphragm valve is opened when the electromagnetic plunger is activated, and is closed when the electromagnetic plunger is not activated.

10. The recording apparatus as set forth in claim 1, wherein the output generator includes a permanent magnet disposed on the float member, and a magnetoelectric element which generates the electrical output in accordance with a magnetic flux density, which changes according to the position of the float member.

11. The recording apparatus as set forth in claim 10, wherein the magnetoelectric element is a hall element.

12. The recording apparatus as set forth in claim 11, wherein a plurality of magnetoelectric elements are arranged so as to generate output signals having different phases in accordance with a movement of the permanent magnet provided with the float member.

13. The ink jet recording apparatus as set forth in claim 12, wherein two magnetoelectric elements are arranged above and below a predetermined level of ink such that both elements are able to detect the magnetic flux generated from the permanent magnet so that three ink levels are recognized.

14. The recording apparatus as set forth in claim 13, wherein the magnetoelectric elements are arranged such that the following states are recognized by the output signals therefrom:

a first state indicating an ink end state a second state indicating the ink replenishment needs starting;

a third state indicating the ink replenishment needs terminating; and a fourth state indicating an ink overflow state.

15. The recording apparatus as set forth in claim 1, further comprising a timer, which starts counting a time period when an ink replenishing valve is opened;

wherein the ink amount detector includes a consumed ink amount calculator, which calculates an ink amount consumed in the subtank;

wherein the ink replenishing valve is opened when the consumed ink amount calculated by the consumed ink amount calculator is a predetermined value or more wherein the ink replenishing valve is closed when the ink amount detector detects that the replenished ink amount in the subtank is a predetermined level or more, which indicates an ink full state; and wherein the ink amount detector includes an ink end detector which determines that the main tank is in an ink end state when the ink amount detector does not detect the ink full state, even if the timer counts a predetermined time period.

16. The recording apparatus as set forth in claim 15, wherein the ink amount detector includes a residual ink amount detector, which detects an ink amount remaining in the main tank, wherein the determination of the ink end detector is made effective when the residual ink detector detects that the residual ink amount is a predetermined amount or less.

17. The recording apparatus as set forth in claim 16, wherein the consumed ink amount calculator and the residual ink amount detector respectively calculate the consumed ink amount and the residual ink amount by multiplying coefficients which are respectively provided in association with ink ejection for printing, ink ejection for flushing, and ink suction for cleaning.

18. The recording apparatus as set forth in claim 15, wherein the ink amount detector includes a float member floating on ink stored in the subtank, an output generator which generates an electrical output in accordance with a floating position of the float member, which changes according to the stored ink amount.

19. The recording apparatus as set forth in claim 1, wherein the replenishment controller forcibly closes the ink replenishment valve when a predetermined time period is elapsed after the ink replenishment valve is opened.

20. The ink jet recording apparatus as set forth in claim 19, wherein a recovery operation is performed when the ink amount detector detects an ink overflow state in which the ink amount stored in the subtank is a predetermined value or more.

21. The recording apparatus as set forth in claim 20, wherein the recovery operation is either one of an operation for discharging ink from the recording head or an operation for consuming ink.

22. The recording apparatus as set forth in claim 21, wherein the discharging operation is performed by sealing a nozzle formation face of the recording head with a capping member and applying therein negative pressure generated by a suction pump.

23. The recording apparatus as set forth in claim 22, wherein the discharging operation is repeatedly performed; and wherein the ink overflow state is checked every time when the discharging operation is performed.

24. The recording apparatus as set forth in claim 23, wherein an error condition is recognized when the ink overflow state is detected even after the discharging operation is repeated at a predetermined number of times.

25. The recording apparatus as set forth in claim 21, wherein the consuming operation is performed by executing a predetermined amount of printing.

26. The recording apparatus as set forth in claim 21, wherein the printing is continued until printing for a subject page is finished.

27. The recording apparatus as set forth in claim 19, wherein the ink amount detector rechecks the ink overflow state after the recovery operation is completed.

28. The recording apparatus as set forth in claim 27, wherein a printable condition of the apparatus is continued when the ink overflow state is not detected by the rechecking.

29. The recording apparatus as set forth in claim 27, wherein an error condition of the apparatus is recognized when the ink overflow state is detected by the rechecking.

30. The recording apparatus as set forth in claim 27, wherein an error message is displayed on a display when the ink overflow state is detected by the rechecking.

31. The recording apparatus as set forth in claim 27, wherein an alarm message is displayed on a display when the ink overflow state is not detected by the rechecking.

32. The ink jet recording apparatus according to claim 1, wherein ink stored in the main tank is replenished to the subtank when the ink amount detector detects that the ink amount stored in the subtank is a predetermined amount or less; and wherein the ink amount detector detects an ink low level which is determined as an ink amount capable of remaining in the subtank even after ink consumption by a single cleaning operation.

33. The recording apparatus as set forth in claim 32, wherein the predetermined amount detected by the ink amount detector is an ink amount consumed by a single cleaning operation or more.

34. The recording apparatus as set forth in claim 32, wherein the predetermined amount detected by the ink amount detector is an ink amount, which is defined by subtracting an ink amount replenished during the cleaning operation from an ink amount consumed by a single cleaning operation, or more.

35. The recording apparatus as set forth in claim 1, wherein the ink amount detector includes:

an electrically rewritable memory, provided with the main tank;

a consumed ink amount calculator, which provides information regarding an ink amount consumed in the subtank, which is written in the memory;

a residual ink amount detector, which provides information regarding an ink amount remaining in the main tank, which is written in the memory; and an ink end detector which provides information regarding whether the main tank is in an ink end state, which is written in the memory.

36. The recording apparatus as set forth in claim 35, wherein the consumed ink amount information and the residual ink amount information are calculated by respectively multiplying the consumed ink amount and the residual ink amount with coefficients which are respectively provided in association with ink ejection for printing, ink ejection for flushing, and ink suction for cleaning.

37. The recording apparatus as set forth in claim 35, wherein the information provided by the ink end detector is associated with an ink end flag provided in the memory.

38. The recording apparatus as set forth in claim 35, wherein the consumed ink amount information and the residual ink amount information are converted into first numeral values which indicate the ink end state of the main tank, when the ink end detector provides information indicating that the main tank is in the ink end state.

39. The ink jet recording apparatus as set forth in claim 38, wherein the consumed ink amount information and the residual ink amount information are provided as numeral values, which are incremented or decremented;

wherein the increment and the decrement of the numeral values are stopped at second numeral values which is in the vicinity of the first numeral values; and wherein the second values are converted into the first values when the ink end detector provides information indicating that the main tank is in the ink end state.

40. The recording apparatus as set forth in claim 1, wherein the ink amount detector includes a physical detector, which detects that the main tank is in an ink end state.

41. The ink jet recording apparatus as set forth in claim 40, wherein the physical detector includes a mechanical switch.

42. The recording apparatus as set forth in claim 40, wherein the physical detector includes an optical sensor.

43. The recording apparatus as set forth in claim 40, wherein the physical detector includes a pair of electrode terminals.

44. The recording apparatus as set forth in claim 1, wherein the ink amount detector detects the ink amount stored in the subtank by calculating an amount of ink ejected or sucked from the recording head.

45. The recording apparatus as set forth in claim 1, wherein the ink amount detector includes an ink end detector which determines that the main tank is in an ink end state when an ink amount replenished to the subtank is less than a predetermined level which indicates an ink full state, even if a time period spent for the ink replenishment is a predetermined time period or more.

46. An ink jet recording apparatus comprising:

a recording head, mounted on a carriage which reciprocally moves in a widthwise direction of recording paper;

a subtank, mounted on the carriage for supplying ink;

a valve member, provided in a flow passage connecting the subtank and the recording head;

a main tank, storing ink which is replenished to the subtank;

an ink amount detector, which detects an amount of ink stored in the subtank; and a replenishment controller, which controls replenishment of ink stored in the main tank to the subtank, in accordance with the ink amount detected by the ink amount detector, wherein the replenishment controller is provided in a replenishment passage which connects the main tank and the subtank; and wherein the replenishment controller includes a pump, which is operated in accordance with the ink amount detected by the ink amount detector, for replenishing ink stored in the main tank to the subtank.

47. The recording apparatus as set forth in claim 46, wherein the replenishment controller includes a pump for replenishing ink stored in the main tank to the subtank, and a pump controller which controls the pump in accordance with a drive signal sent to the recording head.

48. An ink jet recording apparatus comprising:

a recording head, mounted on a carriage which reciprocally moves in a widthwise direction of recording paper;

a subtank, mounted on the carriage for supplying ink;

a main tank, storing ink which is replenished to the subtank;

an ink amount detector, which detects an amount of ink stored in the subtank;

a replenishment controller, which controls replenishment of ink stored in the main tank to the subtank, in accordance with the ink amount detected by the ink amount detector, further comprising:

a timer, which counts a time period in which the apparatus is not operated;

a discharger, which discharges ink stored in the subtank; and a refilling controller, which controls the discharger and the replenishment controller so as to discharge ink stored in the subtank and to replenish ink stored in the main tank to the subtank, when the apparatus is recovered from the non-operating state and a time period counted by the timer reaches a predetermined time period.

49. The recording apparatus as set forth in claim 48, further comprising a residual ink amount sensor, which detects an ink amount remaining in the subtank which is in the non-operating state, wherein the predetermined time period is made shorter as less amount of ink is detected by the residual ink sensor.

50. The recording apparatus as set forth in claim 48, wherein a part of ink left in the subtank is discharged when the apparatus is recovered from the non-operating state.

51. A method of replenishing ink stored in a main tank to a subtank mounted on a carriage reciprocally moving in a widthwise direction of recording paper, together with a recording head, which are incorporated in an ink jet recording apparatus, the method comprising:

applying pressure generated by a compressor to the main tank;

operating an ink replenishing valve provided in a replenishment passage which connects the main tank and the subtank, so as to be opened and closed repeatedly in a single replenishing operation;

wherein the ink replenishing valve is opened and closed irrespective of the reciprocate movement of the carriage.

52. The replenishing method as set forth in claim 51, wherein the pressure applying step includes the steps of operating the compressor so as to be driven and stopped repeatedly in accordance with a pressure state in an air passage connecting the compressor and the main tank.

53. The replenishing method as set forth in claim 51, wherein the ink replenishing valve is opened when it is detected that the ink amount stored in the subtank is less than a first predetermined volume, and closed when it is detected that a replenished ink amount in the subtank reaches a second predetermined volume; and wherein the ink replenishing valve is forcibly closed when a predetermined time period is elapsed after the ink replenishing valve is opened.

54. The replenishing method as set forth in claim 53, further comprising the step of displaying an error message, when the ink replenishing valve is forcibly closed.

55. A method of checking replenishment of ink stored in a main tank to a subtank mounted on a carriage reciprocally moving in a widthwise direction of recording paper, together with a recording head which are incorporated in an ink jet recording apparatus, the method comprising:

detecting an ink amount replenished to the subtank;

discharging ink from the recording head when it is detected an ink overflow state in which the replenished ink amount detected by the detecting step exceeds a predetermined value;

checking whether the subtank is in the ink overflow state by detecting again an ink amount replenished to the subtank, after the discharging step;

continuing a printable condition of the apparatus when the ink overflow state is not detected by the checking step; and determining an error condition of the apparatus when the ink overflow state is detected by the checking step.

56. The checking method as set forth in claim 55, wherein the discharging step includes the steps of sealing a nozzle formation face of the recording head with a capping member; and applying therein negative pressure generated by a suction pump.

57. A method of checking replenishment of ink stored in a main tank to a subtank mounted on a carriage reciprocally moving in a widthwise direction of recording paper, together with a recording head, which are incorporated in an ink jet recording apparatus, the method comprising:

detecting an ink amount replenished to the subtank;

discharging ink from the recording head when it is detected an ink overflow state in which the replenished ink amount detected by the detecting step exceeds a predetermined value, while incrementing a number of which the ink overflow state is detected;

repeating the discharging step and the incrementing step while comparing the detected number with a predetermined number; and detecting an error condition of the apparatus when the detected number reaches the predetermined number.

58. The checking method as set forth in claim 57, wherein the discharging step includes the steps of:

sealing a nozzle formation face of the recording head with a capping member, and applying therein negative pressure generated by a suction pump.

59. A method of checking replenishment of ink stored in a main tank to a subtank mounted on a carriage reciprocally moving in a widthwise direction of recording paper, together with a recording head, which are incorporated in an ink jet recording apparatus, the method comprising:

detecting an ink amount replenished to the subtank;

performing a predetermined amount of printing when it is detected an ink overflow state in which the replenished ink amount detected by the detecting step exceeds a predetermined value, checking whether the subtank is in the ink overflow state by detecting again an ink amount replenished to the subtank, after the printing step;

continuing a printable state of the apparatus when the ink overflow state is not detected by the checking step; and determining an error state of the apparatus when the ink overflow state is detected by the checking step.

60. The checking method as set forth in claim 59, wherein the printing step is continued until printing for a subject page is finished.

* * * * *